US007055923B2

(12) United States Patent
Mochizuki et al.

(10) Patent No.: US 7,055,923 B2
(45) **Date of Patent: *Jun. 6, 2006**

(54) RECORDING HEAD, SUBSTRATE FOR USE OF RECORDING HEAD, AND RECORDING APPARATUS

(75) Inventors: Muga Mochizuki, Kanagawa-ken (JP); Ichiro Saito, Kanagawa-ken (JP); Hiroyuki Ishinaga, Tokyo (JP); Yoshiyuki Imanaka, Kanagawa-ken (JP); Nobuyuki Matsumoto, Tokyo (JP); Yoichi Taneya, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/975,533

(22) Filed: Oct. 29, 2004

(65) Prior Publication Data

US 2005/0057589 A1 Mar. 17, 2005

Related U.S. Application Data

(62) Division of application No. 10/189,230, filed on Jul. 5, 2002, which is a division of application No. 09/589,159, filed on Jun. 8, 2000, now Pat. No. 6,439,680.

(30) Foreign Application Priority Data

Jun. 14, 1999 (JP) ..... 11-167375

(51) Int. Cl.
*B41J 29/38* (2006.01)

(52) U.S. Cl. ..... 347/10; 347/11; 347/60

(58) Field of Classification Search ..... 347/10, 347/11, 60, 9, 5, 12

See application file for complete search history.

(56) References Cited

U.S. PATENT DOCUMENTS

| | | | | |
|---|---|---|---|---|
| 4,573,058 | A | 2/1986 | Brooks | 347/191 |
| 4,613,873 | A | 9/1986 | Tamukai | 347/33 R |
| 4,723,129 | A | 2/1988 | Endo et al. | 347/56 |
| 4,982,199 | A | 1/1991 | Dunn | 347/19 |
| 5,083,137 | A | 1/1992 | Badyal et al. | 346/1.1 |
| 5,172,134 | A | 12/1992 | Kishida et al. | 346/1.1 |
| 5,489,353 | A | 2/1996 | Brungardt | 156/89 |
| 5,563,635 | A | 10/1996 | Kneezel et al. | 347/12 |
| 5,751,302 | A | 5/1998 | Rezanka | 347/9 |

(Continued)

FOREIGN PATENT DOCUMENTS

DE 34 39 115 5/1985

(Continued)

*Primary Examiner*—Hai Pham
*Assistant Examiner*—Lam Nguyen
(74) *Attorney, Agent, or Firm*—Fitzpatrick, Cella, Harper & Scinto

(57) ABSTRACT

A recording head comprises a plurality of recording elements for performing recording; a driving circuit for driving the plurality of recording elements; and a predetermined voltage generating circuit for generating a predetermined voltage to be applied to the plurality of recording elements from voltage supplied from outside. With the head thus structured, a desired voltage is generated in the interior of the head by use of the predetermined voltage generating circuit for performing recording, thus making it possible to prevent the voltage drop which may take place if the voltage is supplied from outside through a cable, as well as to prevent the durability of the heat generating elements from being damaged due to noises. It also becomes possible to set the voltage to be applied to the recording elements at an optimal value corresponding to the discharge voltage, hence stabilizing ink discharges efficiently.

16 Claims, 19 Drawing Sheets

U.S. PATENT DOCUMENTS

| | | | | |
|---|---|---|---|---|
| 5,995,127 | A | 11/1999 | Uzuka | 347/204 |
| 6,076,919 | A | 6/2000 | Shirota et al. | 347/60 |
| 6,116,714 | A | 9/2000 | Imanaka et al. | 347/19 |
| 6,139,125 | A | 10/2000 | Otsuka et al. | 347/9 |
| 6,168,251 | B1 | 1/2001 | Imanaka et al. | 347/9 |
| 6,186,610 | B1 | 2/2001 | Kocher et al. | 347/11 |
| 6,193,344 | B1 | 2/2001 | Otsuka et al. | 347/11 |
| 6,224,181 | B1 | 5/2001 | Koitabashi | 347/15 |
| 6,243,111 | B1 | 6/2001 | Imanaka et al. | 347/13 |
| 6,334,660 | B1 | 1/2002 | Holstun et al. | 347/19 |
| 6,439,680 | B1 | 8/2002 | Mochizuki et al. | 347/10 |
| 6,554,383 | B1 | 4/2003 | Nagatomo et al. | 347/9 |
| 2002/0171696 | A1* | 11/2002 | Mochizuki et al. | 347/9 |

FOREIGN PATENT DOCUMENTS

| | | |
|---|---|---|
| EP | 0 202 922 | 11/1986 |
| EP | 0 499 373 | 8/1992 |
| EP | 0 827 838 | 3/1998 |
| JP | 6-24863 | 2/1994 |
| JP | 6-24864 | 2/1994 |

* cited by examiner

RECORDING HEAD, SUBSTRATE FOR USE OF RECORDING HEAD, AND RECORDING APPARATUS

This is a divisional application of application Ser. No. 10/189,230, filed on Jul. 5, 2002, which is a divisional application of application Ser. No. 09/589,159, filed on Jun. 8, 2000, which issued as U.S. Pat. No. 6,439,680 on Aug. 27, 2002.

BACKGROUND OF THE INVENTION

1. Field of the Invention

The present invention relates to a recording head for recording desired images on a recording medium, a substrate for use of a recording head, and a recording apparatus. The present invention is applicable to an apparatus, such as a printer that records on paper, thread, fiber, cloth, leather, metal, plastics, glass, wood, ceramics, or the like, a copying machine, a facsimile equipment with communication systems, a word processor with a printing unit. Further, the invention is applicable to the recording system for industrial use, which is arranged by combining various processing devices complexly here, the term "recording" used for the present invention is not only applied to the provision of meaningful images, such as characters and graphics, for a recording medium, but also, applied to the provision of the images which are not meaningful, such as patterns, for the recording medium.

2. Related Background Art

For the conventional recording head, there are a thermal head that records by transferring heat to an ink ribbon or a thermosensitive paper using heat generating elements, an ink jet head that records by discharging ink using piezoelectric elements. Hereunder, the description will be made of an ink jet head by exemplifying the one that records by discharge ink using heat generating elements.

With heat and other energy given to ink, change of states is created in ink, which is accompanied by abrupt voluminal changes (creation of bubbles). Then, ink is discharged from discharge ports by the active force exerted by such change of states. The ink thus discharged is allowed to adhere to a recording medium for the formation of images. This is called an ink jet recording method, which is conventionally known as the so-called bubble jet recording method. As disclosed in the specification of U.S. Pat. No. 4,723,129, and others, the recording apparatus that adopts this bubble jet recording method comprises, in general, the discharge ports that discharge ink; the ink flow paths which are communicated with the discharge ports; and recording elements serving as energy generating means, which are arranged in the ink flow paths to discharge ink, respectively.

With the recording method of the kind, high quality images can be recorded at high speeds with a lesser amount of noises. At the same time, the head that performs this recording method makes it possible to arrange discharge ports in high density therefor. As a result, among some others, this head has an excellent advantage that images are recorded in high resolution with a smaller apparatus, and also, color images can be made easily. With such advantages, the bubble jet recording method has been widely unutilized in recent years for a printer, a copying machine, a facsimile equipment, and many other office machines and equipments. Further, it has begun to be used for textile printing systems, and some others for industrial use.

Now that the recording elements that generate energy for discharging ink are manufactured by use of the semiconductor manufacturing processes, the conventional head which has been made by the utilization of the bubble jet technologies and techniques is structured in such a manner that a substrate is formed by arranging recording elements on an elemental base plate formed by a silicon base plate, and that a ceiling plate formed by polysulfone or-some other resin or glass or the like, which is provided with grooves, is bonded with such substrate to provide ink flow paths.

Also, by the utilization of the elemental base plate being formed by the silicon base plate, not only the recording elements are formed on the elemental base plate, but also, the driving circuit that drives the recording elements, the temperature sensor which is used to control the temperature of the recording elements, the driving controllers, and some others are arranged thereon. FIG. 15 shows one example of an elemental base plate of the kind.

In FIG. 15, there are formed on the elemental base plate 1001, the heater group 1002 having a plurality of heat generating elements (recording elements) 1005 formed by resistive elements that give thermal energy for use of ink discharges, which are arranged in parallel; a driving circuit 1003 having a plurality of transistors 1008 for driving each of the heating elements 1005, which are arranged in parallel; a control circuit 1004 for controlling each of the transistors 1008 on the driving circuit 1003; and input terminals 1007 for receiving image data, each kind of signals, and the like from outside. Also, for the elemental base board 1001, a temperature sensor that measures the temperature of the elemental base plate 1001 or a sensor 1006, such as a resistance sensor, for measuring the resistive value of each of the heat generating elements.

The control circuit 1004 comprises shift registers that outputs to the driving circuits 1003 the image data which are received serially from outside; the latch circuits that store data provisionally and output them to the transistors 1008; a driving control circuit that drives the sensor 1006, and controls the width of pulses to drive the heat generating elements 1005 in accordance with output from the sensor 1006. In this respect, the control circuit 1004 may be arranged to output image data individually or may be arranged to divide the heater group 1002 into plural blocks and output image data per unit block, among some others. In this manner, a plurality of shift registers are arranged for one head, and then, the image data transmitted from the ink jet recording apparatus are allotted to a plurality of shift registers, thus making the printing speed higher with ease.

As the sensor 1006, a temperature sensor that measures the temperature in the vicinity of the heat generating elements, a resistance sensor that monitors the resistive value of the heat generating elements, or the like is used.

As regards the discharge amounts in terms of the liquid droplets to be discharged, it is conceivable that the discharge amount is related mainly to the bubbled value of ink the bubble value of ink changes depending on the heat generating elements 1005 and the circumferential temperature thereof as well. The temperature of the heat generating elements 1005 and that of the circumference thereof are measured by the temperature sensor. In accordance with the result thus obtained, the pulses, which gives energy only in an intensity small enough so as not to allow ink to be discharged (preheat pulses), are added before applying the heat pulses that enables ink to be discharged. Then, it is practiced that the pulse width of such preheat pulses or the output timing is controlled to change for adjusting the temperatures of the heat generating elements 1005 and the circumference thereof in order to maintain the image quality by discharging ink droplets in a specific amount.

Also, as regards the energy required for bubbling ink in terms of the heat generating elements 1005, the energy can be expressed by the product of the input energy per unit area which is needed for the heat generating elements 1005 and the area of the heat generating elements 1005, provided that the condition of the heat radiation is constant. In this way, the voltage applied to both ends of each heating element 1005, the electric current running on each heat generating element 1005, and the pulse width should be set only at the value at which the required energy is obtainable. The electric current running on each of the heat generating elements 1005 has different resistive value of the heat generating element 1005 depending on each lot or each elemental base plate 1001 due to the varied film thickness of the heat generating elements which may be obtained in the manufacturing process of the elemental base plate 1001.

Therefore, if the resistive value of the heat generating element 1005 is greater than the set value, the value of running electric current becomes smaller, provided that the width of the applied pulse is constant. Then, the amount of the input energy of the heat generating element 1005 becomes insufficient to make it impossible to bubble ink appropriately. On the contrary, if the resistive value of the heat generating elements 1005 is made smaller, the value of electric current becomes greater than the set value even if the same voltage is applied. In this case, an excessive energy is generated by each of the heat-generating elements 1005 to bring about a possibility that the heat generating elements 1005 are damaged or the life thereof is made shorter. Now, therefore, the resistive value of each of the heat generating elements 1005 is monitored by means of resistance sensor at all the time. Then, it is arranged that the width of heat pulses is changed in accordance the value thus obtained so that substantially a specific energy is applied to each of the heat generating elements.

As described above, the conventional ink jet head which is provided with the elemental base plate, there is a need for the provision of two kinds of voltage supply sources for supplying a voltage for use of the heat generating elements, and a voltage for use of the control circuit that drives it. These voltages are supplied from the main body of the ink jet recording apparatus.

In order to supply the source voltage to the ink jet head which is mounted on a carriage that moves along the surface of a recording medium for printing, the ink jet head and the main body of the recording apparatus is connected by means of a comparatively long cable, such as a flexible base plate. As the structure is thus arranged, the voltage for heater application which is supplied to the ink jet head may be caused to drop in some cases if many numbers of heat generating elements are driven at a time.

For the conventional ink jet head, therefore, the voltage that should be applied to the heat generating elements is set at a value higher than the voltage required for the performance of discharge (hereinafter referred to as the discharge voltage) with such a voltage drop in view. As a result, the durability of the heat generating elements is subjected to being deteriorated.

Also, noises tend to be superposed on the signals or voltages transmitted through the cable, such as flexible base plate. There is a possibility that the heat generating elements are damaged by spiking noises or the durability thereof is deteriorated if not damaged.

In recent years, there have been heavy demands on the high quality image output by an ink jet recording apparatus along with the widening fields of various products, respectively. At the same time, it is required that the recording speeds are improved. As a result, the number of nozzles (ink flow paths) should be increased for discharging ink, and the recording cycle should also be shortened. Then, the width of driving pulses should be shortened when applied to each of the heat generating elements, and at the same time, the number of recording elements should be increased for a simultaneous driving.

However, the voltages that are applied to the heat generating elements of the conventional ink jet head are the fixed ones. Therefore, when controlling the ink discharge energies corresponding to the kinds of ink or the sizes of each heat generating element, there is no other way than to control it only by changing the width of heat pulses. With the structure thus arranged, the pulse width cannot be shortened at all. It is, therefore, difficult to deal with the requirement of higher speeds (the discharge frequency being 10 kHz or more, or 20 kHz or more in some cases, for instance), and the provision of multiple nozzles which should be required as well.

SUMMARY OF THE INVENTION

It is one of the objects of the present invention to provide a recording head capable of stabilizing the supply source voltage applicable to recording elements, at the same time, optimally controlling ink discharge energy corresponding to the kind of ink and recording elements in order to meet the requirement of higher speed recording with multiple nozzles, and also to provide a substrate for use of such recording head, as well as a recording apparatus.

It is another object of the invention to provide a recording head which comprises a plurality of recording elements for performing recording; a driving circuit for driving the plurality of recording elements; and a predetermined voltage generating circuit for generating a predetermined voltage to be applied to the plurality of recording elements from voltage supplied from outside.

It is still another object of the invention to provide a substrate for use of recording head which comprises a base plate; a plurality of recording elements provided for the base plate for performing recording; a driving circuit for driving provided for the base plate to drive each of the plurality of recording elements; and a predetermined voltage generating circuit provided for the base plate to generate a predetermined voltage to be applied to the plurality of recording elements from voltage supplied from outside.

It is a further object of the invention to provide a recording apparatus which comprises a recording head provided with a plurality of recording elements for performing recording; a driving circuit for driving each of the plurality of recording elements; and a predetermined voltage generating circuit to generating a predetermined voltage to be applied to the plurality of recording elements from voltage supplied from outside; a carriage having the recording head mounted thereon for traveling; means for generating the voltage to be supplied from outside.

In accordance with the present invention, a desired voltage is generated in the interior of the head by use of a predetermined voltage generating circuit for performing recording, thus making it possible to prevent the voltage drop which may take place if the voltage is supplied from outside through a cable, as well as to prevent the durability of the heat generating elements from being damaged due to noises. Particularly, with the output of the voltage for use of recording elements from the predetermined voltage generating circuit, it becomes possible to set the voltage to be applied to the recording elements at an optimal value corresponding to the discharge voltage, hence stabilizing the ink discharges efficiently.

Also, a plurality of desired voltages are generated from the predetermined voltage generating circuit to supply such voltages per group of recording elements. In this manner, it becomes possible to optimize the setting of the voltage to be applied to the recording elements corresponding to the kind of ink and recording elements. Therefore, even with a high speed head having multiple nozzles, it is easy to control the ink discharge energy appropriately.

Further, the voltage for recording elements which is applied to the recording elements and the voltage for control circuit which is applied to the control circuit are supplied form the predetermined voltage generating circuit, respectively. Therefore, the supply-source voltage which is supplied to the head can be only one kind, thus reducing the load given to the main body of the apparatus. In this case, the voltage for use of the recording element application is allowed to rise after the voltage for the control circuit has risen. Then, the voltage for use of the control circuit is allowed to fall after the voltage for use of the recording element application has fallen or the application of the voltage for use of the recording elements is made only when printing is in operation. In this way, it becomes possible to prevent the malfunction of the recording elements, hence enhancing the reliability of the head.

Also, with the provision of the predetermined voltage generating circuit for the same base plate as the one having a plurality of recording elements arranged thereon, the number of parts can be reduced to make the assembling operation easier.

DETAILED DESCRIPTION OF THE PREFERRED EMBODIMENTS

Hereinafter, with reference to the accompanying drawings, the present invention will be described.

FIRST EMBODIMENT

Figure 1A:
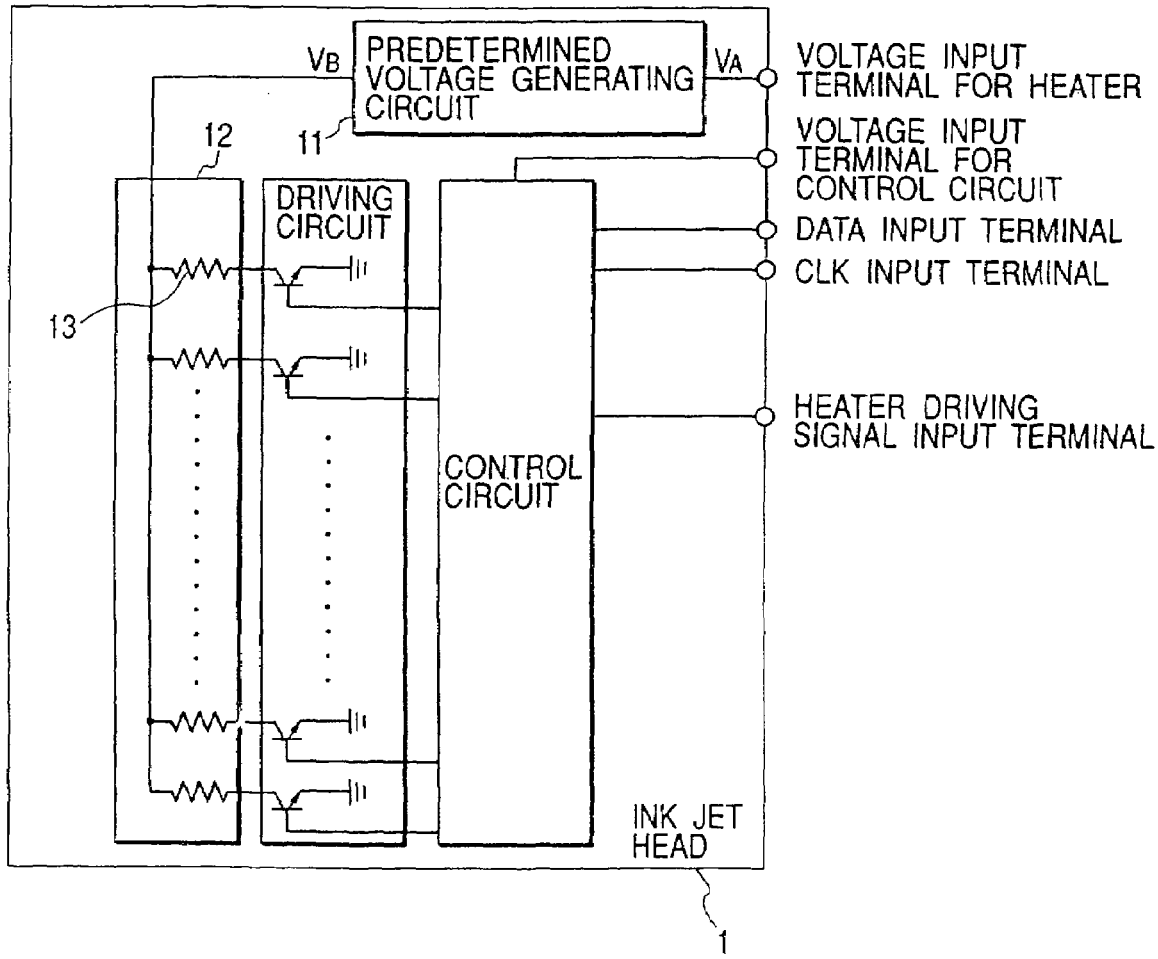
FIGS. 1A and 1B are block diagrams which illustrate the structure of an ink jet head in accordance with a first embodiment of the present invention.
Figure 1B:
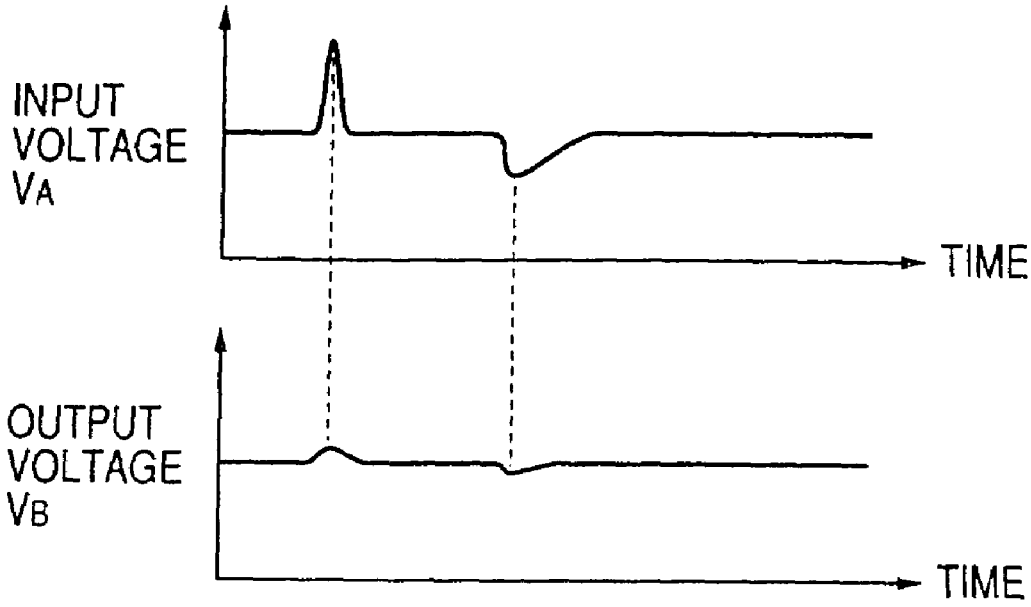
Figure 2:
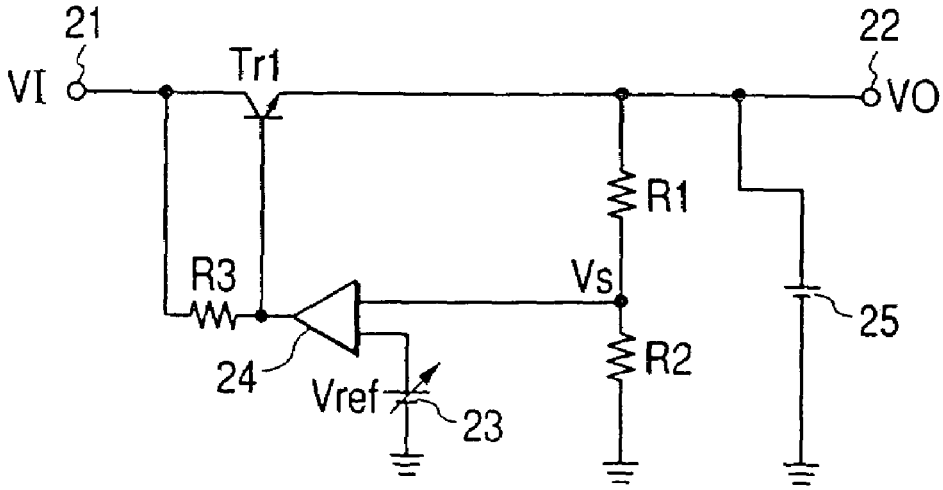
FIG. 2 is a diagram which shows one structural example of the circuit that generates a predetermined voltage represented in FIGS. 1A and 1B.

FIGS. 1A and 1B are block diagrams which illustrate the structure of an ink jet head in accordance with a first embodiment of the present invention. FIG. 2 is a diagram which shows one structural example of the circuit that generates a predetermined voltage represented in FIGS. 1A and 1B.

As shown in FIG. 1A, the ink jet head 1 of the present embodiment is structured to be provided with a predetermined voltage generating circuit (a voltage conversion circuit) 11 for supplying voltage for heater application to each of the heat generating elements 13 of the heater group 12 formed on the elemental base plate.

As shown in FIG. 2, the predetermined voltage generating circuit 11 comprises a transistor Tr1 inserted between the input terminal 21 and the output terminal 22; resistors R1 and R2 for detecting the output voltage VO output from the output terminal 22 by dividing it; a resistor R3 inserted across the base collectors of the transistor Tr1; a reference voltage supply source 23 that outputs a specific reference voltage Vref; and a differential amplifier circuit 24 that receives the detected voltage Vs detected by the resistors R1 and R2, and the reference voltage Vref, and controls the transistor Tr1 so as to equalize the detected voltage Vs and the reference voltage Vref. Further, in order to stabilize the load variations, a capacitor 25 may be inserted between the output terminal 22 and the grounding potential.

For the circuit shown in FIG. 2, the base current of the transistor Tr1 is controlled by means of the differential amplifier circuit 24 so as to equalize the detected voltage Vs and the reference voltage Vref, and the output voltage VO is constantly controlled against the fluctuation of the input voltage V1 which is received from outside. Here, the reference voltage Vref output from the reference voltage supply source 23 is made variable to make it possible to easily adjust the value of the output voltage VO to a desired voltage.

As described above, with the predetermined voltage generating circuit 11 provided for the ink jet head 1, it becomes possible to maintain the output voltage VB of the predetermined voltage generating circuit 11 substantially at a constant level even when the input voltage VA, which is supplied to the ink jet head 1 from outside, is superposed with spiking noises or the input voltage VA is caused to present a voltage drop as shown in FIG. 1B. Therefore, it becomes possible to apply to each of the heat generating elements 13 the voltage for heater application which rarely fluctuates against the noise input or the drop of external voltage.

In this manner, the damages that may be given to the heat generating elements 13 or the deterioration of the durability thereof due to the spiking noises can be prevented, and even when the supply-source voltage from the main body of an ink jet recording apparatus should drop, the stabilized voltage is applied to each of the heat generating elements 13, hence prevent the life of the heat generating elements 13 from being shortened.

SECOND EMBODIMENT

Figure 3:
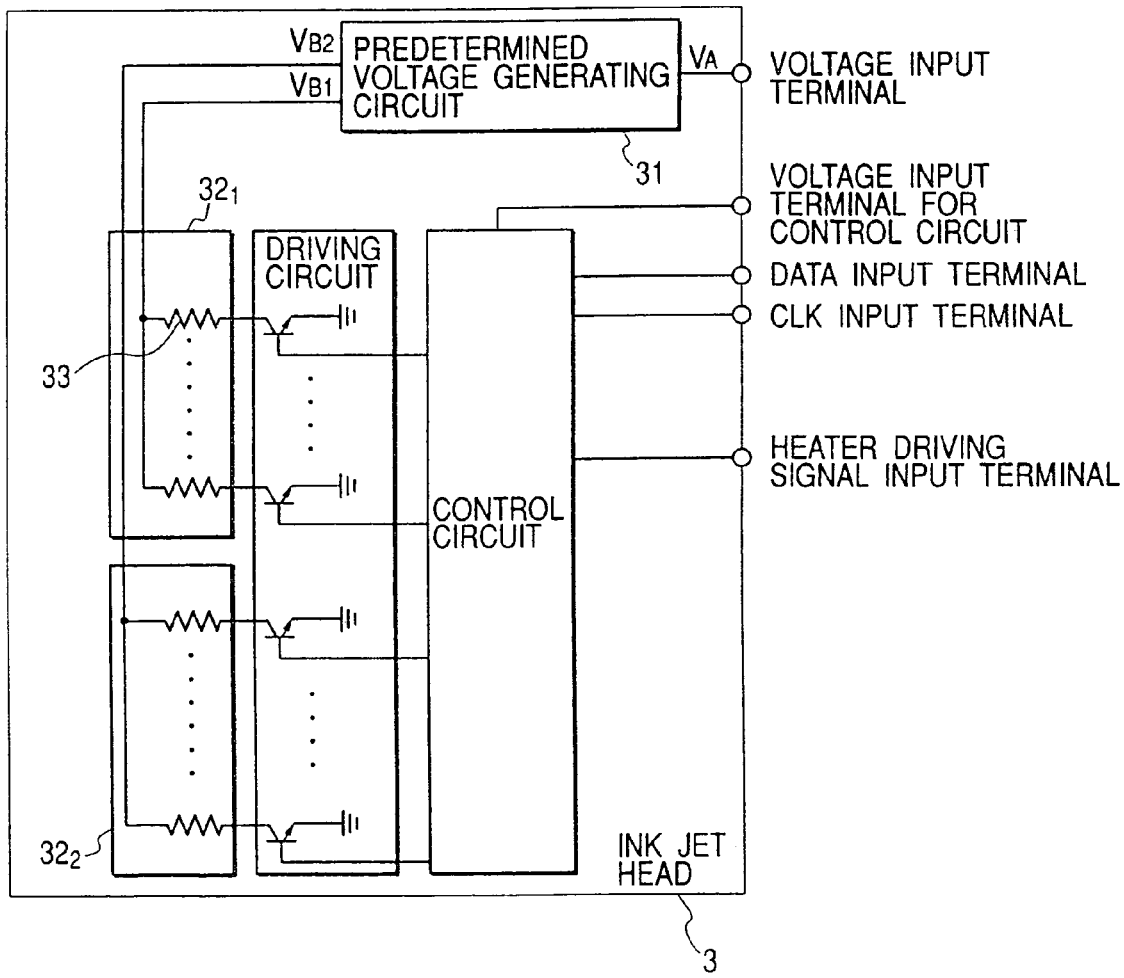
FIG. 3 is a block diagram which shows the structure of an ink jet head in accordance with a second embodiment of the present invention.

FIG. 3 is a block diagram which shows the structure of an ink jet head in accordance with a second embodiment of the present invention.

As shown in FIG. 3, the ink jet head 3 of the present embodiment is structured to divide a plurality of heat generating elements 33 into a plurality of heat groups 32 (two groups 321 and 322 being shown in FIG. 3 as an example) to drive each of the heat generating elements 33 per heater group 32.

The predetermined voltage generating circuit 31 provided for the ink jet head 3 of the present embodiment is structured to provide a plurality of the circuits shown in FIG. 2, for example, and the voltage for heater application is supplied each individually to each of the heater groups 32.

With the structure thus arranged, it becomes possible to set the voltage for heater application at a desired value per heater group 32. For example, therefore, the heat generating elements 33 can be driven with an optimal voltage in accordance with the kind of ink or the size of heat generating elements even if the heat generating elements for use of color ink and those for use of black ink, having different driving conditions, respectively, are arranged altogether for one ink jet head. As a result, it becomes possible to easily control the ink discharging energy for an ink jet head capable of performing at higher speed with the provision of multiple nozzles.

THIRD EMBODIMENT

Figure 4:
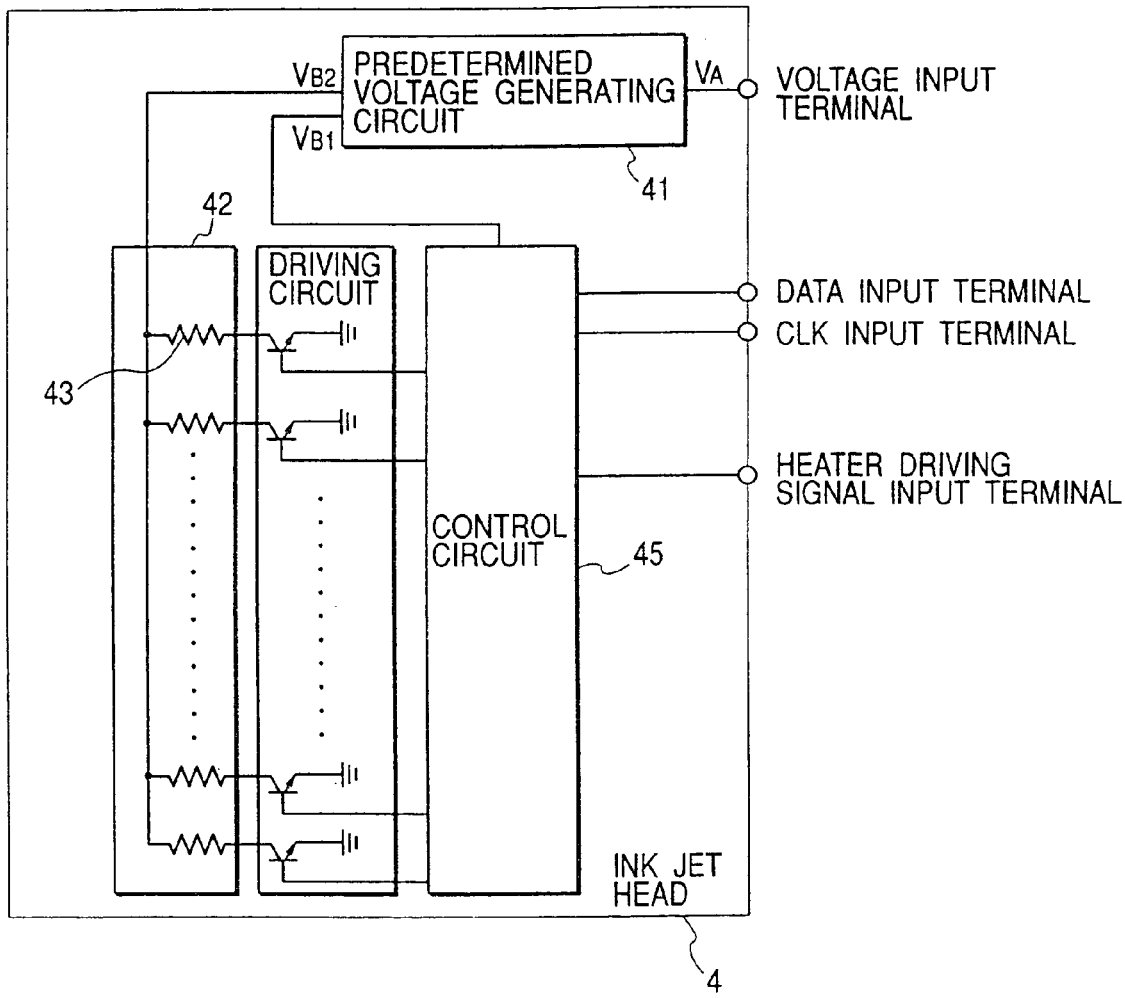
FIG. 4 is a block diagram which shows the structure of an ink jet head in accordance with a third embodiment of the present invention.
Figure 5:
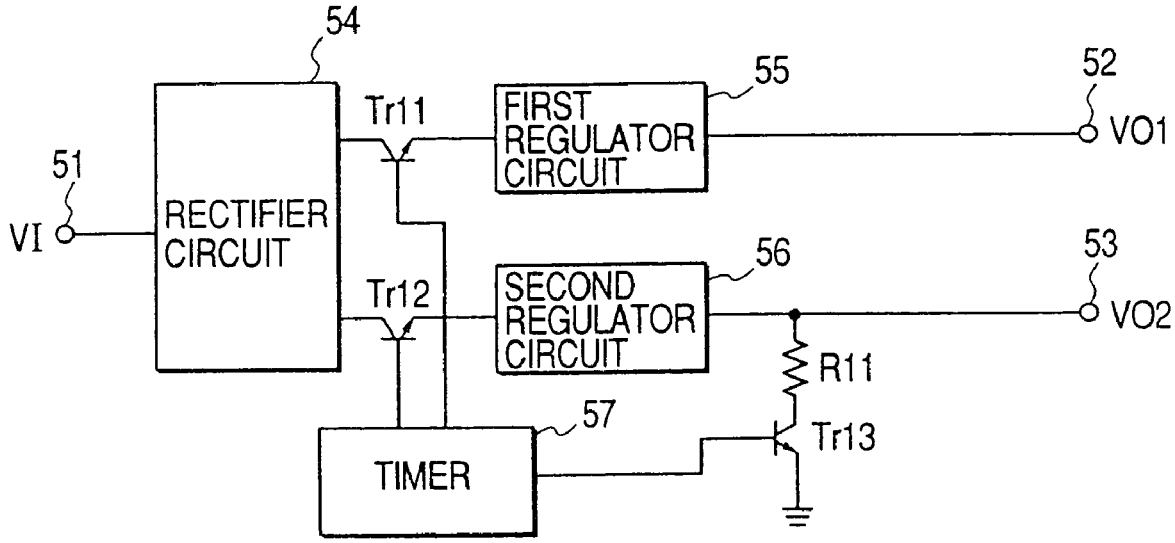
FIG. 5 is a diagram which shows one structural example of the circuit that generates a predetermined voltage represented in FIG. 4.
Figure 6A:
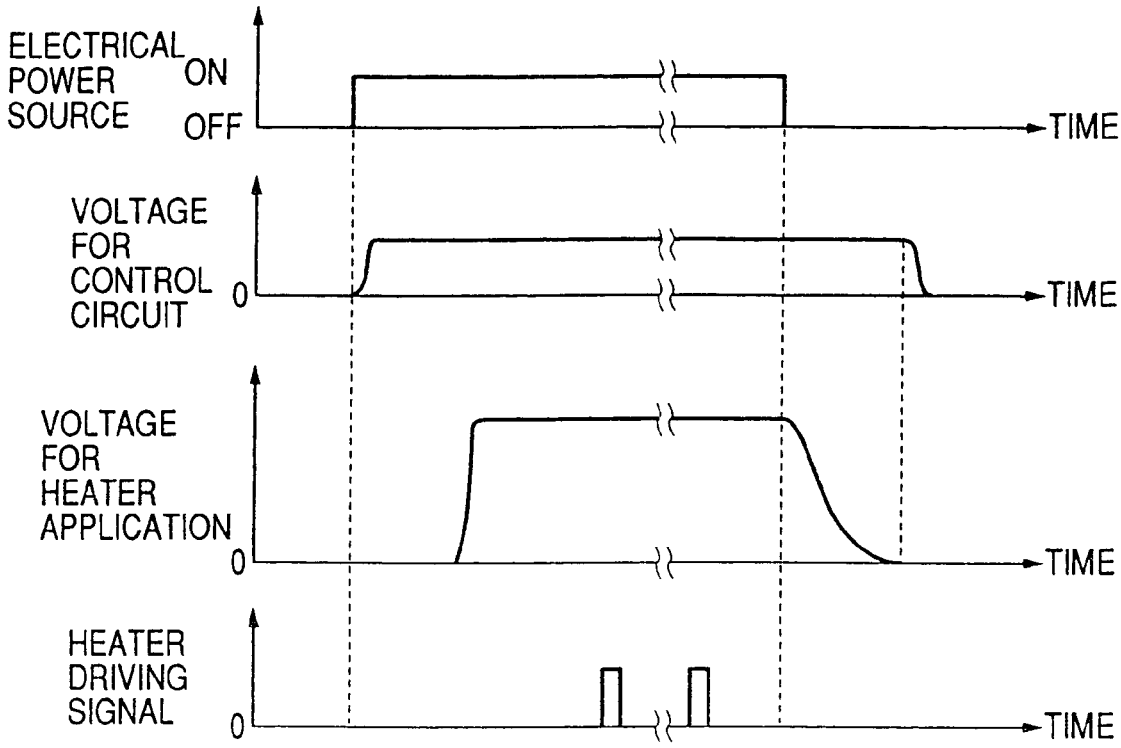
FIGS. 6A and 6B are timing charts which illustrate the rising waveform and the falling waveform of the output voltage of the predetermined voltage generating circuit shown in FIG. 4.
Figure 6B:
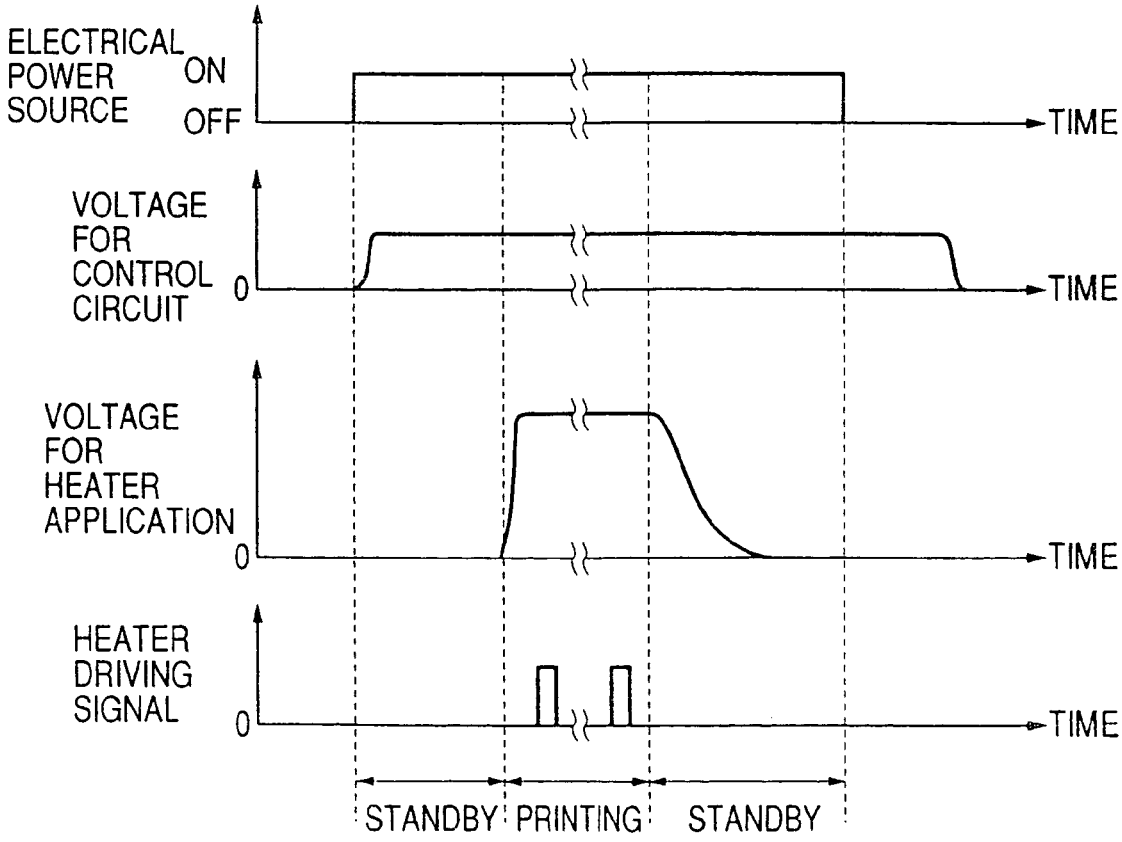

FIG. 4 is a block diagram which shows the structure of an ink jet head in accordance with a third embodiment of the present invention. FIG. 5 is a diagram which shows one structural example of the circuit that generates a predetermined voltage represented in FIG. 4. FIGS. 6A and 6B are timing charts which illustrate the rising waveform and the falling waveform of the output voltage of the predetermined voltage generating circuit shown in FIG. 4.

As shown in FIG. 4, the ink jet head 4 of the present embodiment is structured to supply the voltage for heater application (10V to 40V) and the voltage for control circuit (3.3V or 5V) which is applied in order to drive the control circuit 45 from the predetermined voltage generating circuit 41, respectively.

With the respective supplies of the voltage for heater application and the voltage for control circuit from the predetermined voltage generating circuit 41 as arranged for the present embodiment, the voltage that should be supplied from outside to the ink jet head can be only one kind, hence making it possible to reduce the load on the main body of an ink jet recording apparatus. Particularly, if the supply-source voltage is only one kind, it also becomes possible to drive an ink jet head by use of a battery.

As shown in FIG. 5, the predetermined voltage generating circuit 41 of the present embodiment comprises the rectifier circuit 54 that rectifies the input voltage VI received through the input terminal 51; a first regulator circuit 55 that outputs a desired voltage VO1 from the output terminal 52 by receiving the output voltage from the rectifier circuit 54 as input; a second regulator circuit 56 that outputs a desired voltage VO2 from the output terminal 53 by receiving the output voltage from the rectifier circuit 54 as input; a transistor Tr11 for turning on and off the input voltage to the first regulator circuit 55; a transistor Tr12 for turning on and off the input voltage to the second regulator circuit 56; and a timer 57 that controls the resistor R11 which discharges the output voltage from the second regulator circuit 56, and the transistor Tr13 as well, and also, controls turning on and off the transistors Tr11, Tr12, and Tr13 at specific timing, respectively.

The first regulator circuit 55 and the second regulator circuit 56 are structured by the same circuit as the one shown in FIG. 2, for example. Here, in FIG. 5, the rectifier circuit 54 is arranged on assumption that a voltage of alternating current is supplied form the main body of a recording apparatus, but the rectifier circuit is not needed if a voltage of direct current is supplied from the main body of the recording apparatus.

The circuit shown in FIG. 5 is arranged to turn on the transistor Tr11 earlier than the transistor Tr12 by use of the timer 57 when turning on the transistor Tr11 and transistor Tr12. Also, when turning off the transistor Tr11 and transistor Tr12, the transistor Tr12 is turned off and the transistor Tr13 is turned on. Then, the transistor Tr11 is turned off after the time has elapsed so that the output voltage form the second regulator circuit 56 is discharged sufficiently and becomes 0V.

Here, if it is assumed that the voltage VO1 output from the output terminal 52 is the voltage for control circuit, and that the voltage VO2 output from the output terminal 53 is the voltage for heater application, the voltage for heater application is supplied after the voltage for control circuit has been supplied, and the voltage for control circuit is turned off after the voltage for heater application has been turned off as shown in FIG. 6A.

Also, as shown in FIG. 6B, it may be possible to supply the voltage for heater application to the heater group 42 only when the heat generating elements 43 are driven by use of the timer 57 in accordance with heat driving signals, that is, only during the period in which ink is discharged for printing.

In this manner, if the application timing is controlled so that the voltage for heater application is on and off, while the voltage for control circuit is turned on at all the time, it becomes possible to prevent the malfunction of the heat generating elements 43, thus preventing the heat generating elements 43 from being damaged by any possible malfunction thereof that may take place otherwise. Also, the reliability of the ink jet head is enhanced by protecting the heat generating elements 43 with the voltage for heater application which is supplied to the heat generating elements 43 only when printing is performed.

Also, when the heat generating elements are divided into a plurality of heater groups as in the second embodiment, it is possible to supply a desired voltage to each of the heater groups, respectively, in such a manner that a plurality of the same circuits as the second regulator circuit 56 shown in FIG. 5 are provided for the predetermined voltage generating circuit 41, and then, such circuits are controlled by use of the timer 57 as in the case of the transistors Tr12 and Tr13. In this case, it is possible to obtain the same effect as that obtainable by the second embodiment.

FOURTH EMBODIMENT

Figure 7:
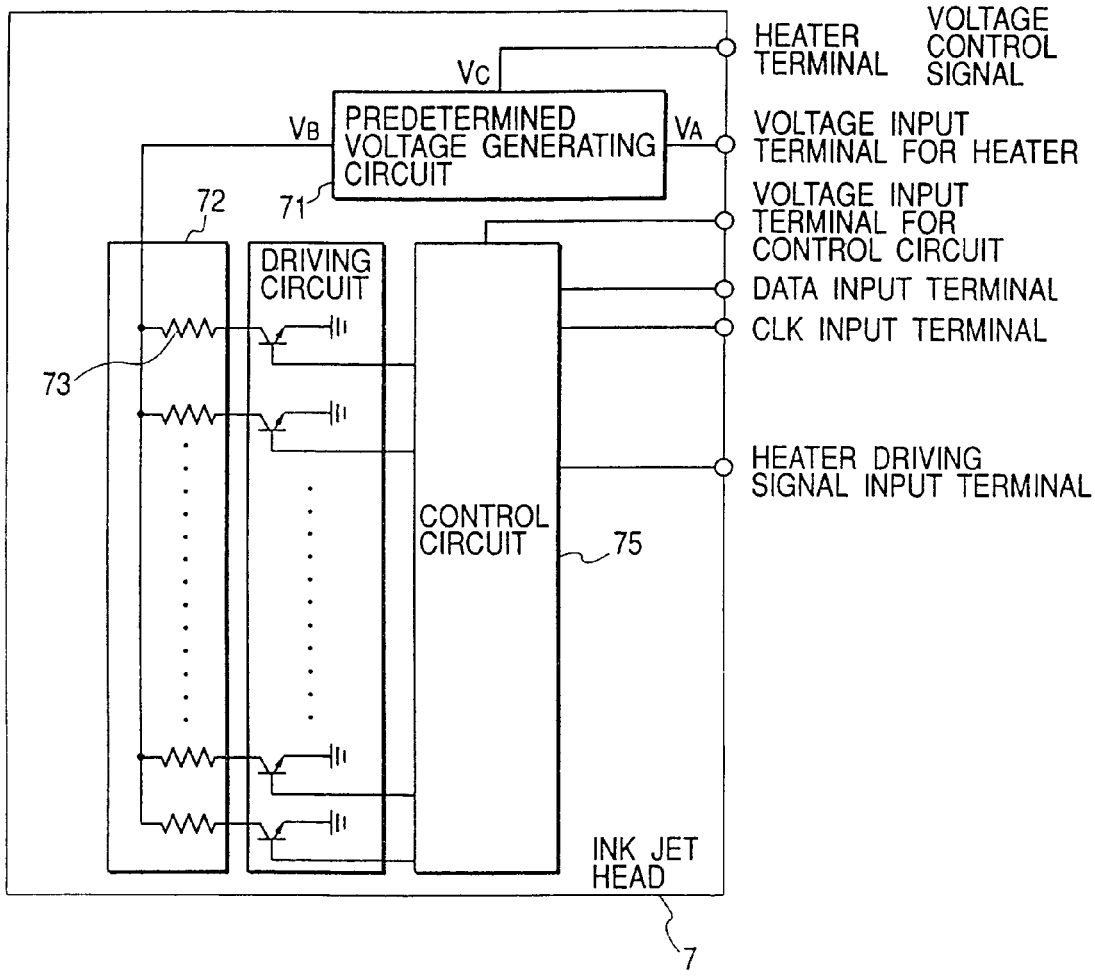
FIG. 7 is a block diagram which shows the structure of an ink jet head in accordance with a fourth embodiment of the present invention.
Figure 8:
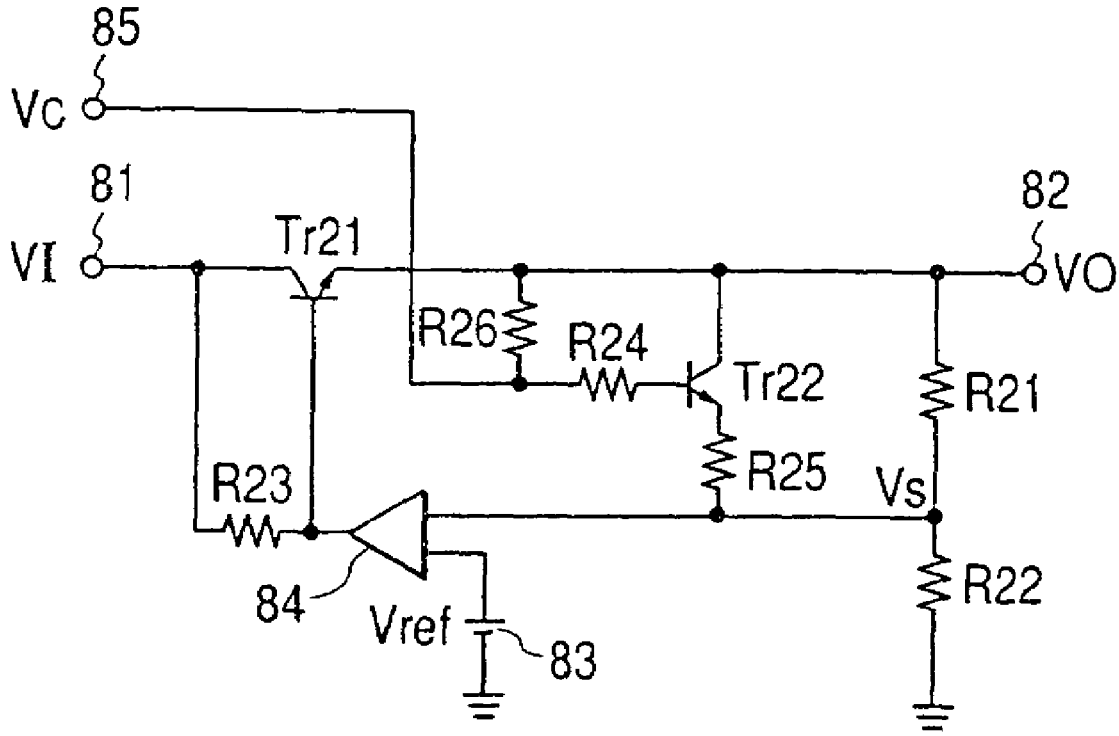
FIG. 8 is a diagram which shows one structural example of the circuit that generates a predetermined voltage represented in FIG. 7.

FIG. 7 is a block diagram which shows the structure of an ink jet head in accordance with a fourth embodiment of the present invention. FIG. 8 is a diagram which shows one structural example of the circuit that generates a predetermined voltage represented in FIG. 7. FIGS. 9A to 9E are timing charts which represent the voltage for heater use which is output from the predetermined voltage generating circuit shown in FIG. 7, and also, the condition of heater driving voltage, which is applied to the heat generating elements.

As shown in FIG. 7, the ink jet head 7 of the present embodiment is structured to receive from outside the ink jet head 7 the signals VC for controlling the heater voltage for use of changing the output voltage VB of the predetermined voltage generating circuit 71. The output voltage VB of the predetermined voltage generating circuit 71 is supplied to the heater group 72 as the voltage for heater application, and the heat driving voltage, which is applied to each of the heat generating elements 73, is made variable from outside by the application of the signals VC for controlling heat voltage As shown in FIG. 8, the predetermined voltage generating circuit 71 of the present embodiment comprises the transistor Tr21 which is inserted between the input terminal 81 and the output terminal 82; the resistors R21 and R22 which detect the output voltage VO output from the output terminal 82 by dividing it; the resistor R23 which is inserted across the base collectors of the transistor Tr21; the reference voltage supply source 83 that outputs a predetermined reference voltage Vref; the differential amplifier circuit 84 that receives the detected voltage Vs detected by the resistors R21 and R22, and the reference voltage Vref as well, and controls the transistor TR21 to equalize the detected voltage Vs and reference voltage Vref; and the transistor Tr22 the base of which receives through the resistor R24 the signals VC for controlling the heater voltage inputted from the control terminal 85, and the collector of which is connected with the output terminal 82, and the emitter of which is connected with the input terminal in which the detected voltage Vs of the differential amplifier is inputted through the resistor R25.

With the structure of the predetermined voltage generating circuit 81 shown in FIG. 8, the base current of the transistor Tr21 is controlled to equalize the detected voltage Vs and the reference voltage Vref by use of the differential amplifier 84 as in the case of the predetermined voltage generating circuit of the first embodiment illustrated in FIG. 2, and the output voltage VO is controlled to be constant against the fluctuation of the input voltage VI from outside.

Here, for the circuit shown in FIG. 8, the transistor Tr22 is not energized when the signals Vc for controlling the heater voltage is at the lever "L". Therefore, the specific output voltage VO is output as it is from the predetermined voltage generating circuit 71. On the other hand, the transistor Tr22 is energized when the signals for controlling the heater voltage is at the level "H". As a result, the resistor R25 which is connected with the emitter of the transistor Tr22 presents the structure which is equal to the one connected in parallel with the resistor R21 for use of the partial pressure. Then, the ratio of the divided pressures by use of the resistors R21 and R22 changes, and the detected voltage Vs becomes greater, and the voltage output from the output terminal 82 is controlled by the voltage VO' which is lower than the output voltage VO.

Figure 9A:
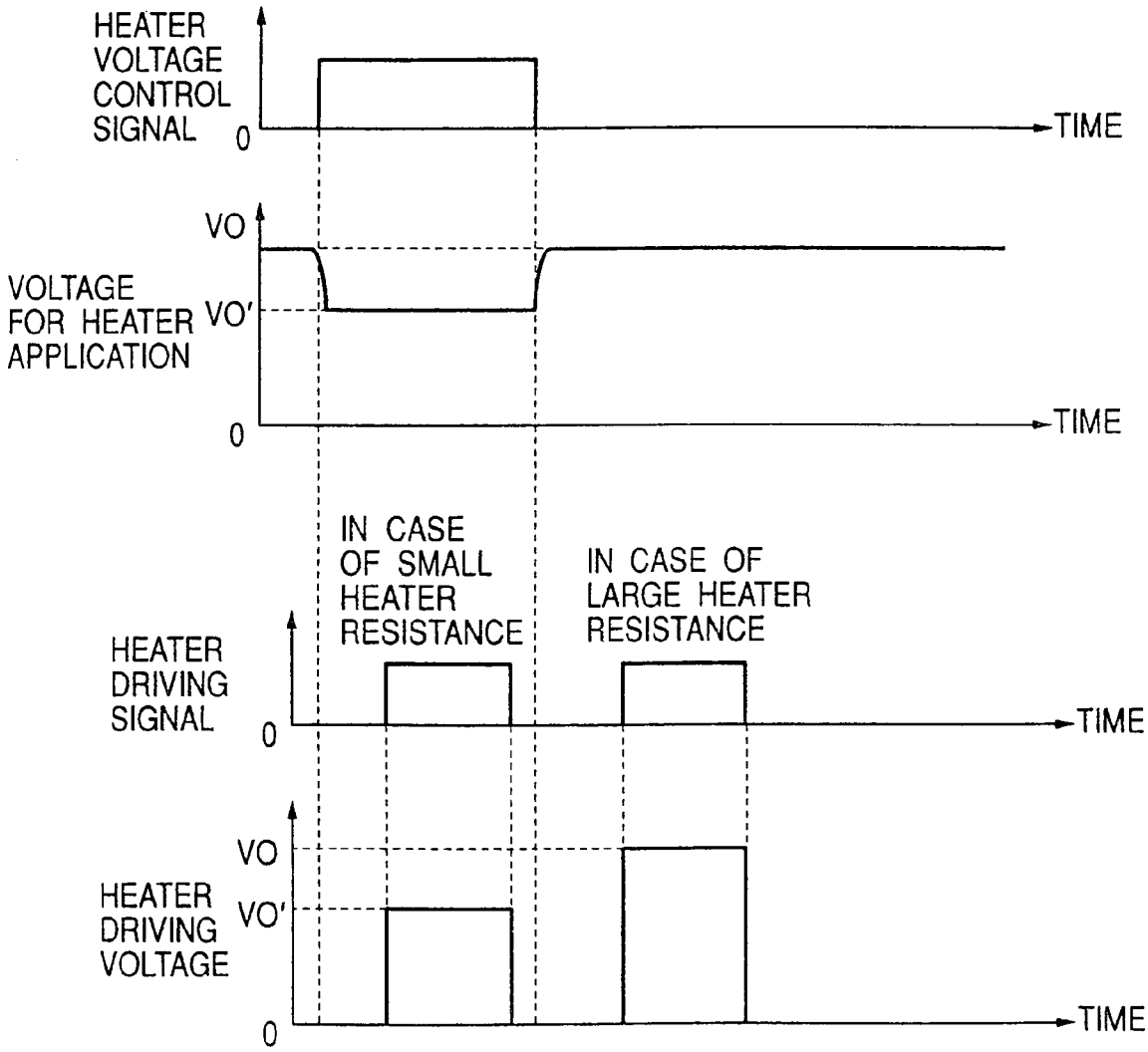
FIGS. 9A, 9B, 9C, 9D and 9E are timing charts which represent the voltage for heater use which is output from the predetermined voltage generating circuit shown in FIG. 7, and also, the condition of heater driving voltage, which is applied to the heat generating elements.

In this manner, with the provision of the predetermined voltage generating circuit 71, the heater driving voltage, which is applicable to each of the heater generating elements (heaters) 73 as the first embodiment as shown in FIG. 9A, can be changed in accordance with the resistive value of the heaters. For example, if the resistive value of the heaters tends to vary for the reasons of manufacture or the like, it is possible to change the value by condition of the heater driving voltage=VO' when the value is as small as 170Ω to 200Ω or by condition of the heater driving voltage=VO when the value is as large as 201Ω to 230Ω. In this way, the driving voltage can be adjusted per resistive value of heaters. Then, the pulse width is made smaller on the whole to make a higher speed possible.

Figure 9B:
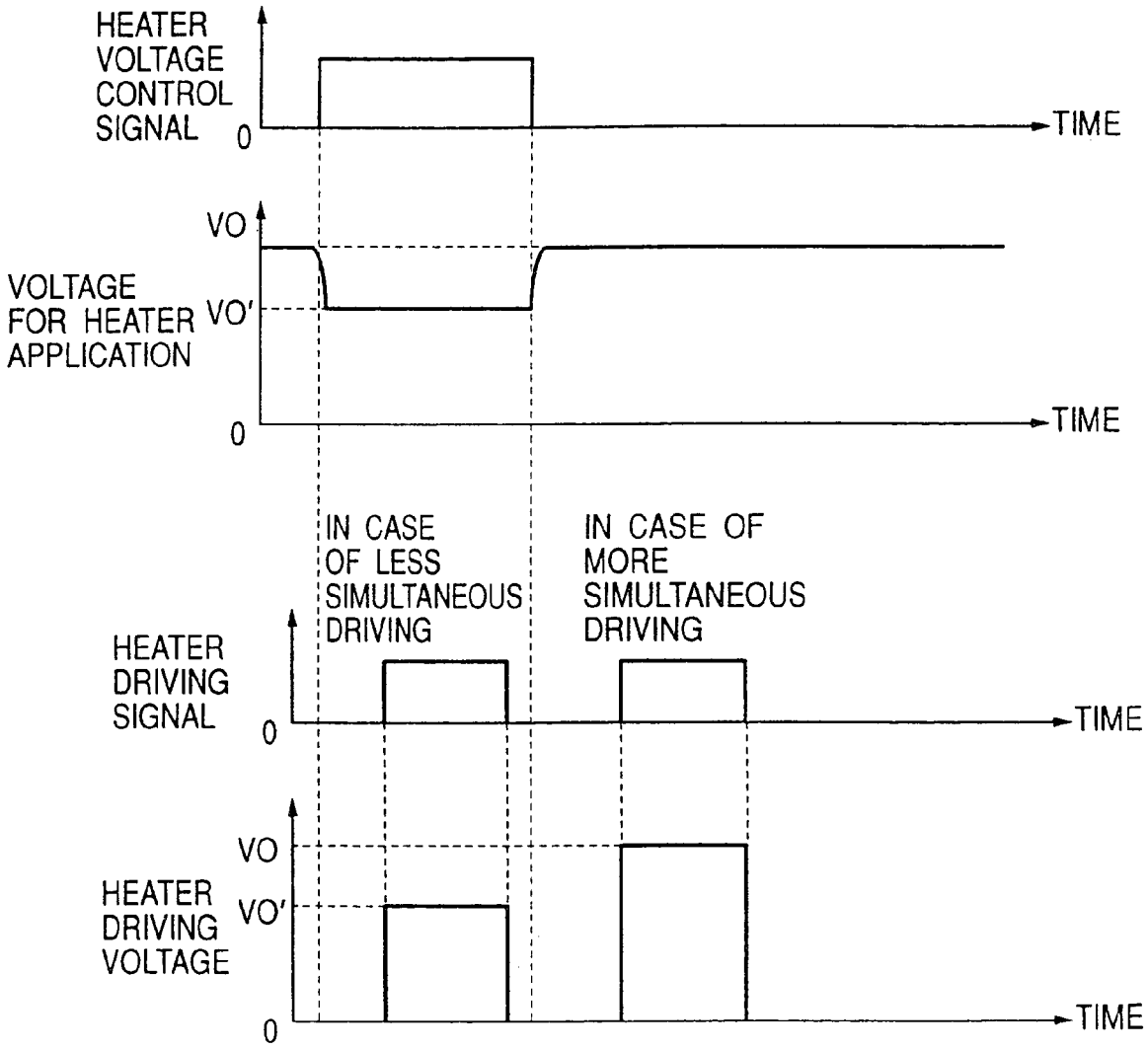

As the second embodiment, the heater driving voltage applicable to the heat generating elements 73 is made variable in accordance with the number of heaters to be driven at a time as shown in FIG. 9B. For example, if the number of heaters for the simultaneous driving is 16 locations at the maximum, the heater driving voltage is changed to be equal to VO for the 9 to 16 locations of simultaneous driving from the heater driving voltage which is equal to VO' for the 1 to 8 locations thereof. In this way, the voltage drop between heaters by can be compensated by use of the predetermined voltage generating circuit, hence making it possible to stabilize discharges irrespective of the number of heaters to be driven at the same time.

Figure 9C:
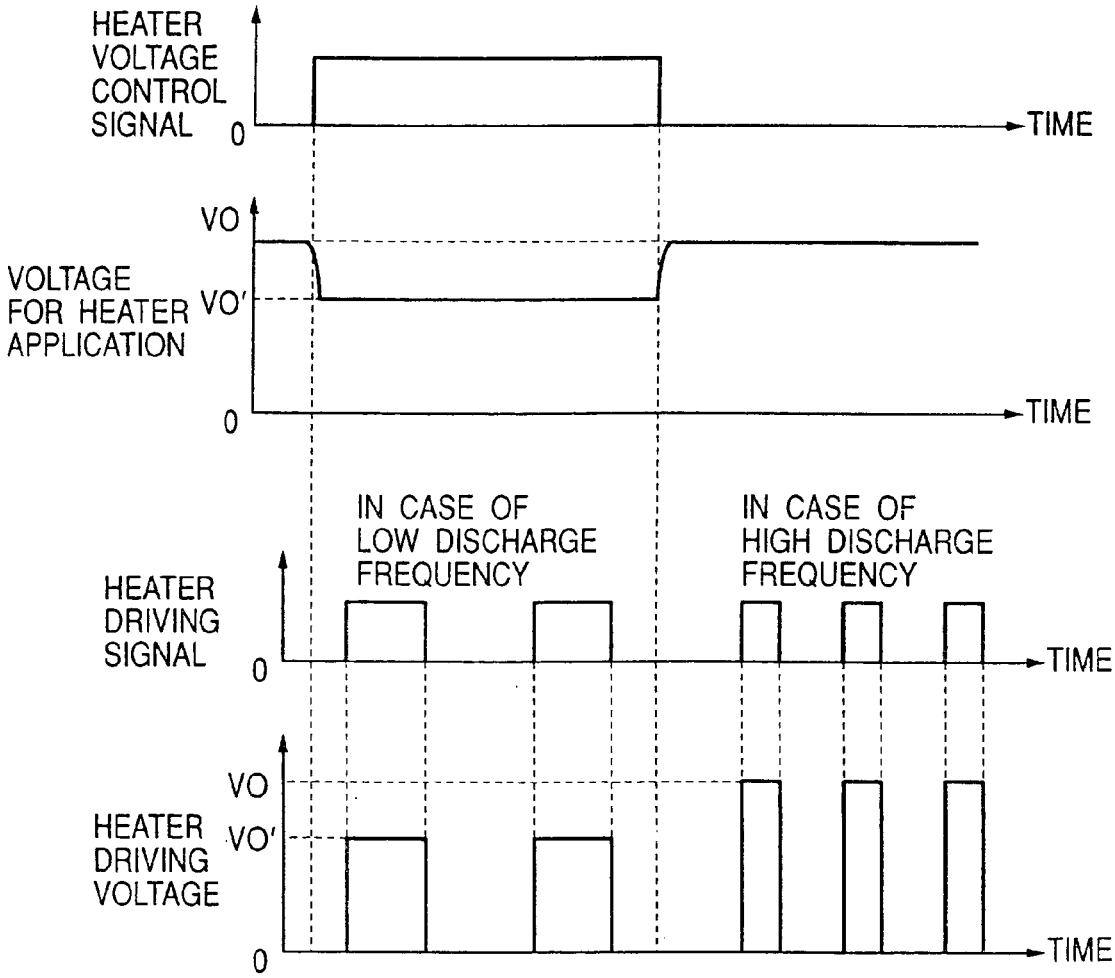

As the third embodiment, it may be possible to change the heater driving voltage applicable to the heat generating elements 73 in accordance with the frequency of heaters to be driven as shown in FIG. 9C. For example, when the discharge frequency of heaters is 20 kHz or less, the heater driving voltage is equal to VO', but this setting is changed to be equal to VO if the discharge frequency is more than 20 kHz. In this way, the optimal driving is possible for each of the printing modes, respectively, so as to stabilize discharges accordingly.

Figure 9D:
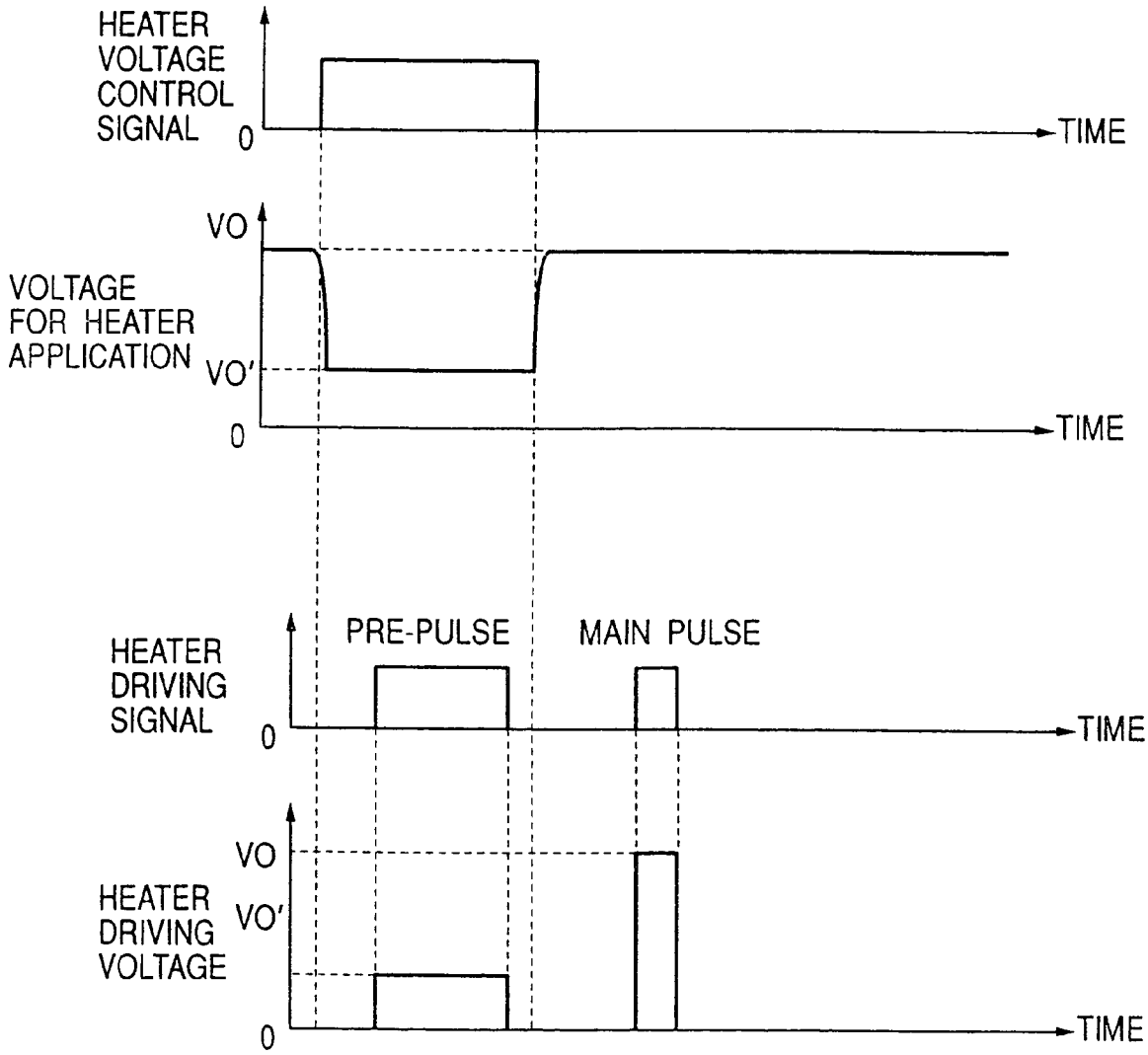
Figure 9E:
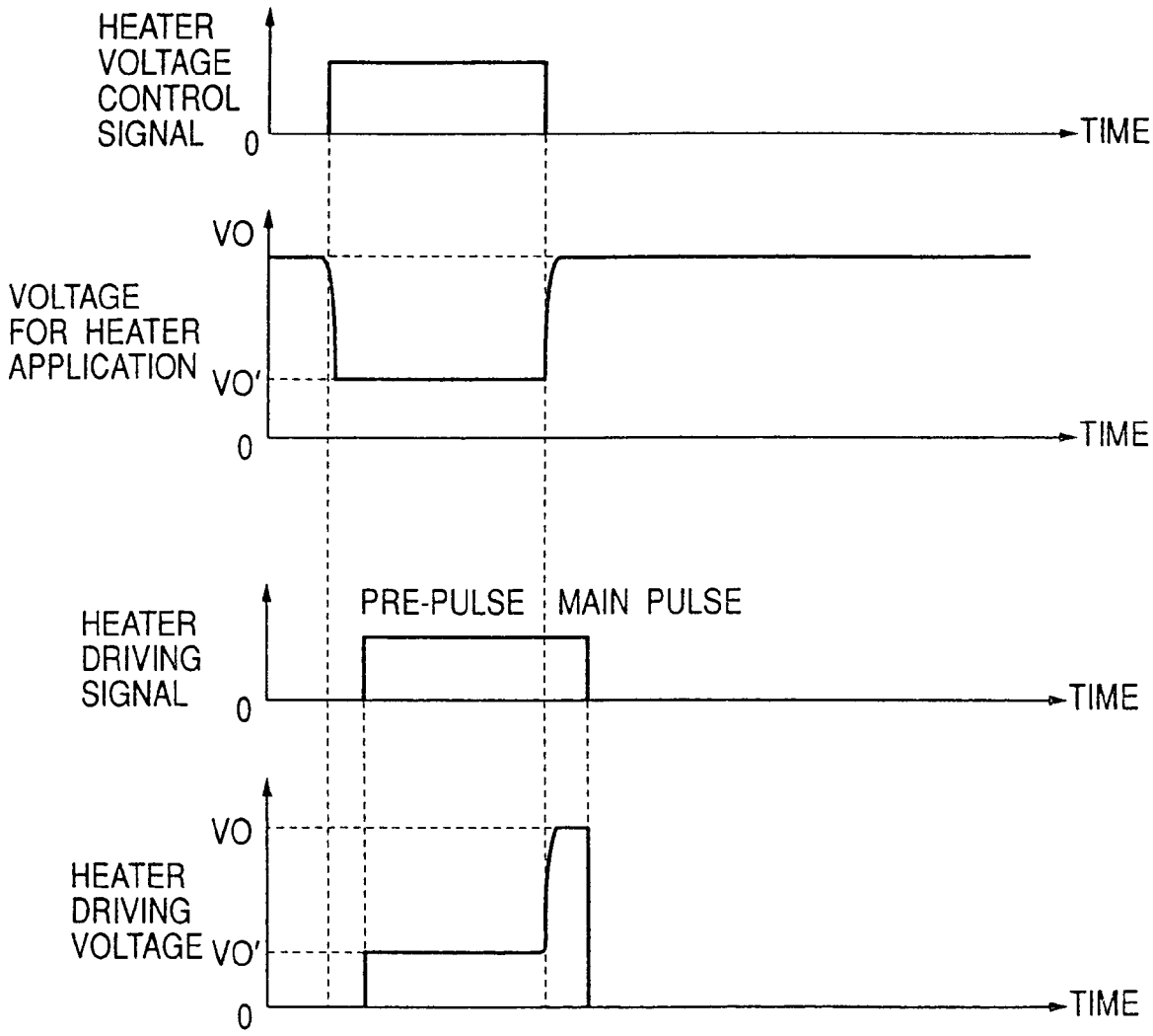

As the fourth embodiment, it may be possible to change the heat driving voltage applicable to the heat generating elements 73 by means of the preheat pulses (heat driving voltage=VO') and the main pulses (heater driving voltage=VO) as shown in FIG. 9D. The preheat pulses are made at a lower voltage so that no bubbling is effectuated, but heating is given for a period of several μs to transfer heat to ink. The main pulses are made stably to effectuate bubbling, and heat is given with short pulses of 1 μs or less but at high voltage. In this way, the optimal heater driving voltage can be supplied to the heat generating elements 73. Therefore, ink can be discharged efficiently and stably. Also, with the structure thus arranged, it becomes possible to make the pulse width 2 μs or less, thus making higher driving possible at the discharge frequency of 15 kHz or 20 kHz or more. FIG. 9E shows the variational example of the one represented in FIG. 9D as the fifth embodiment.

In this respect, the signals VC for controlling the heater voltage is not necessarily limited to the one which is given from outside the ink jet head 7. For example, it may be possible to arrange the structure so that the signals are given from the control circuit 75.

Also, if the heat generating elements are divided into a plurality of heater groups as in the case of the second embodiment, it becomes possible to supply a desired voltage to each of the heater groups with the predetermined voltage generating circuit 71 for which the circuit shown in FIG. 8 is arranged in plural numbers. In this case, the same effect as the one obtainable by the second embodiment can be obtained.

Now, in the first to fourth embodiments, there is no particular reference made to the location where the predetermined voltage generating circuit should be arranged. However, it is preferable form the predetermined voltage generating circuit on the elemental base plate on which the heat generating elements are provided. In this case, it becomes possible to reduce the number of terminals or the like with which the elemental base plate having the heat generating elements formed thereon is connected with some other base plate on which the predetermined voltage generating circuit should be provided, hence making it easier to carry out the assembling process with the reduced number of parts.

In this respect, the predetermined voltage generating circuit may be formed on a head base plate other than the elemental base plate where the heat generating elements are formed. Even in such a case, there is no particular problem in practice, and a desired voltage can be supplied to the heater group and the control circuit as well.

Figure 10:
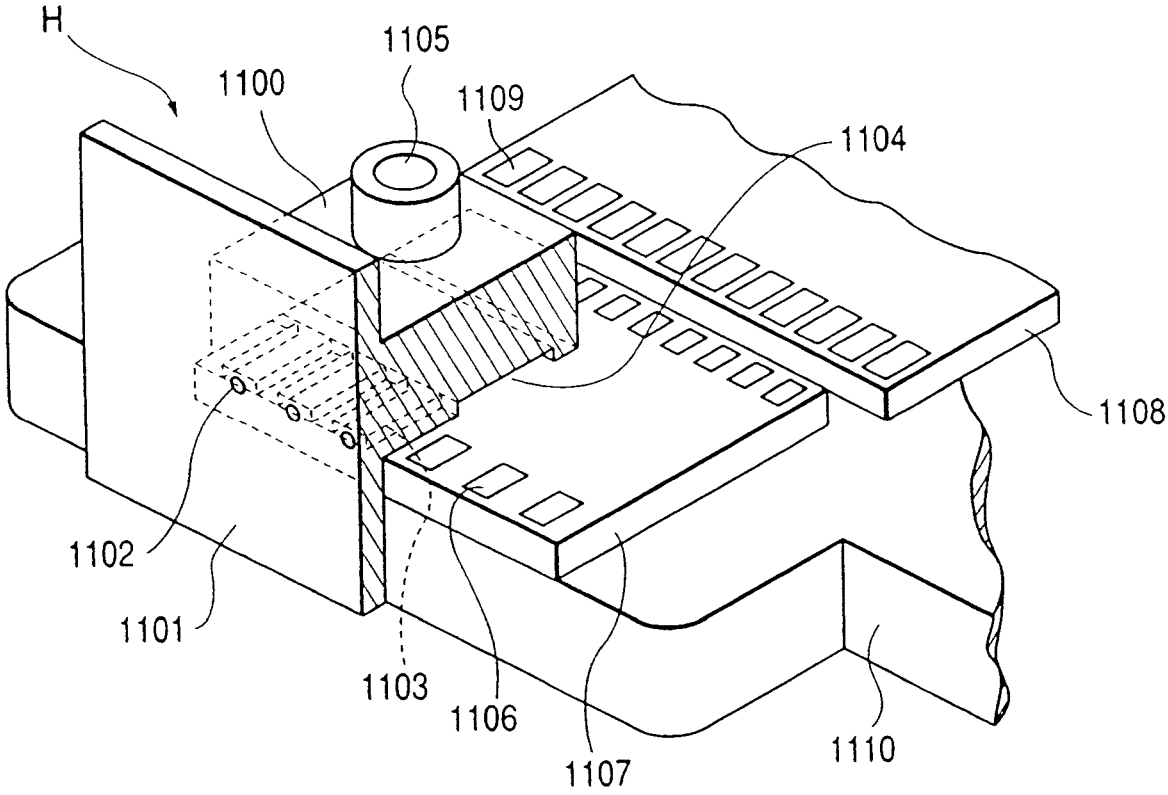
FIG. 10 is a broken perspective view which shows the principal part of an ink jet recording head in accordance with the embodiments of the present invention.

FIG. 10 is a broken perspective view which shows the principal part of an ink jet recording head in accordance with the embodiments of the present invention. The ceiling plate 1100 that constitutes an ink jet head H is formed by resin material. Then, there are integrally formed the ceiling plate 1100 that forms a liquid chamber 1104 that retains recording liquid and a plurality of liquid flow paths 1103, a discharge port formation member 1101 that forms a plurality of discharge ports (orifices) 1102 communicated with each of the liquid flow paths 1103, respectively, and a recording liquid supply port 1105. Also, for the heater board (elemental base plate) 1107, the heaters (electrothermal transducing elements) 1106 which are arranged in plural numbers on the silicon base plate in order to create film boiling by generating the thermal energy which is utilized for discharging ink, and the electric wiring (not shown) of aluminum or the like which supplies electric power to the heaters are formed by the application of known film formation technologies and techniques. Then, on the base plate 1110, the heater board is positioned and fixed by the known bonding techniques. The wiring base plate 1108 is provided with the wiring which is connected with the wiring of the heater board 1107 by means of the known wiring bonding correspondently, and a plurality of pads 1109 which are positioned on the edge portion of the wiring to receive electric signals from the main body of the apparatus. Then, the ceiling plate 1100 and the heater board 1107 are bonded while being positioned to be in agreement with the liquid flow paths 1103 and the heaters 1106, respectively, and fixed to the base plate 1110 together with the wiring base plate 1108, thus forming the ink jet recording head H.

Figure 11:
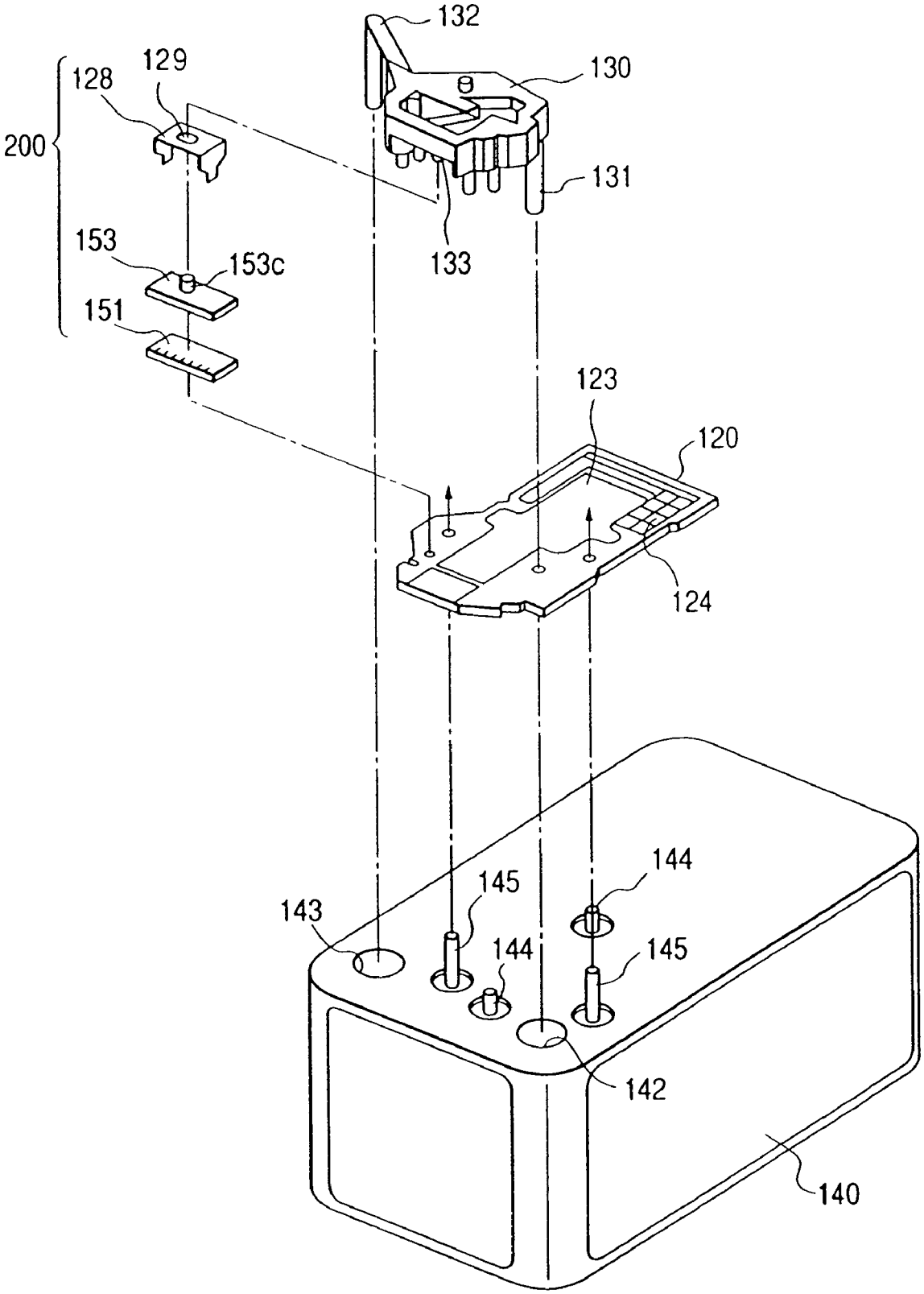
FIG. 11 is an exploded perspective view which shows an ink jet head cartridge to which the present invention is applicable.

Now, the brief description will be made of the ink jet head cartridge with the ink jet head of the above embodiment being mounted thereon. FIG. 11 is an exploded perspective view which schematically shows the ink jet head cartridge including the ink jet head described earlier. Roughly, the ink jet head cartridge is structured mainly with an ink discharge head unit 200 and an ink container 140.

The ink discharge head unit 200 comprises an elemental base plate 151; a ceiling plate 153 with the discharge ports which are open to it; a pressure spring 128; an ink supply member 130; an aluminum base plate (supporting element) 120, among some others. For the elemental base plate 151, a plurality of heat generating resistive elements are arranged in line to give heat to ink as described earlier the liquid flow paths (not shown) are formed by bonding the elemental base plate 151 and the ceiling plate 153 in order to distribute ink in them. The pressure spring 128 is a member that enables biasing force, which is directed to the elemental base plate 151, to act upon the ceiling plate 153. With the biasing force thus exerted, the elemental base plate 151, the ceiling plate 153, and the supporting element 120 to be described later are integrated in good condition. Here, if the ceiling plate and the elemental base plate are bonded by the application of adhesives or the like, it may be unnecessary to provide the pressure spring. The supporting element 120 is a member that supports the elemental base plate 151 and others. On this supporting element 120, there are arranged a printed circuit board 123 or the like connected with the elemental base plate 151 to supply electric signals, and the contact pads 124 which are connected with the apparatus side to exchange electric signals with it.

The ink container 140 contains ink to be supplied to the ink discharge head unit 200. On the outer side of the ink container 140, there are arranged a positioning member 144 for arranging the connecting member that connects the ink discharge head unit 200 and the ink container 140, and the fixing shaft 145 that fixes the connecting member. Ink is supplied to the ink supplies 131 and 132 of the ink supply member 130 through the ink supply paths 142 and 143 of the ink container 140, and then, supplied to the common liquid chamber through the liquid supply paths 133, 129, and 153*c* of each member. Here, the ink supply from the ink container 140 to the ink supply member 130 is divided into two passages, but this supply is not necessarily divided.

Here, after ink has been consumed, the ink container 140 may be used again by refilling ink therein. For this purpose, it is desirable to provide an ink injection port for the ink container 140. Also, it may be possible to integrate the ink discharge head unit 200 and the ink container 140 together or to make them separable.

Figure 12:
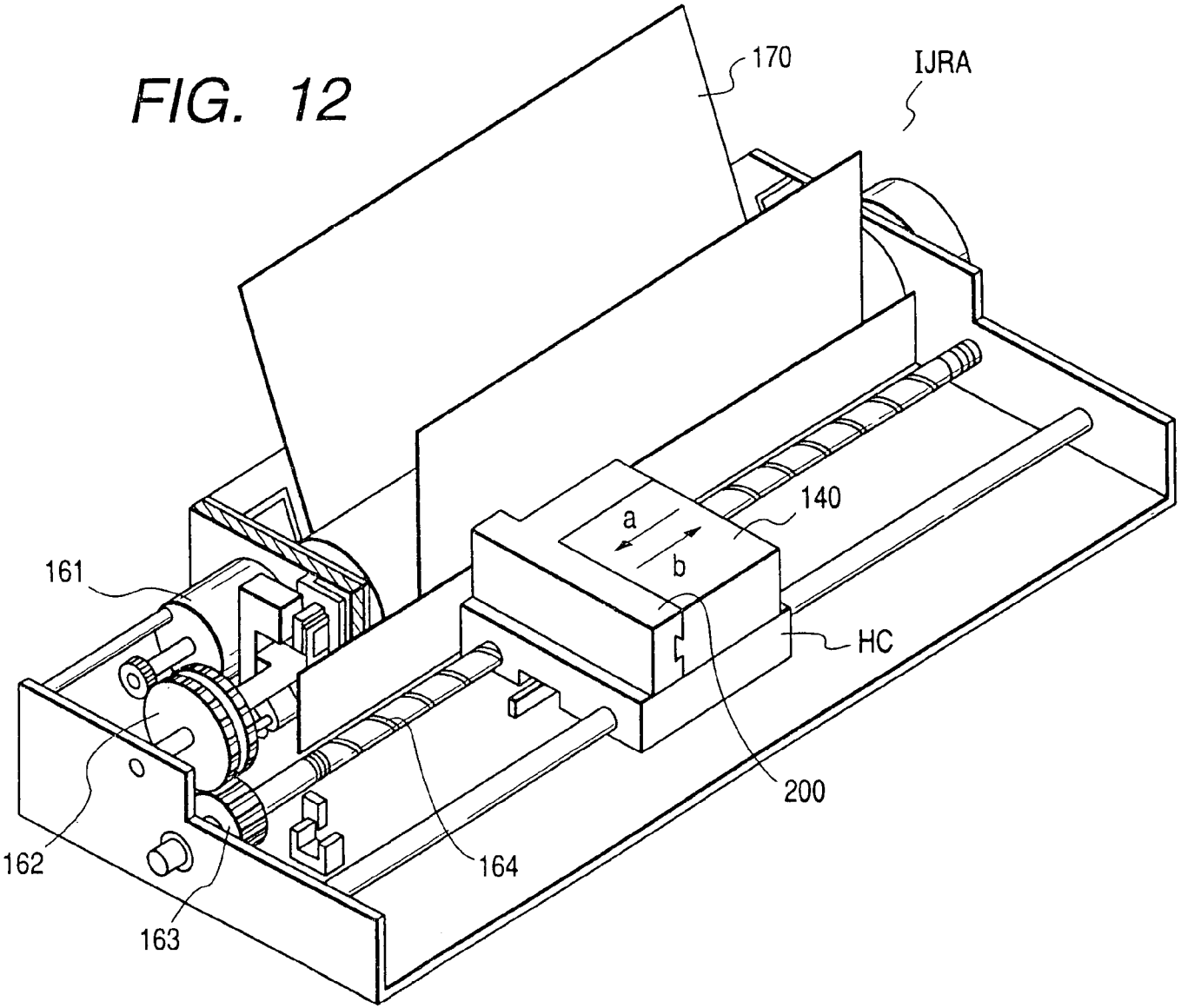
FIG. 12 is a view which schematically shows the structure of the ink jet recording apparatus to which the present invention is applicable.

FIG. 12 is a view which schematically shows an ink jet recording apparatus on which the aforesaid ink jet head is installed. The carriage (scanning device) HC of the ink jet recording apparatus mounts on it the head cartridge provided with the ink container 140 that contains ink, and the ink discharge head unit 200 detachably. The carriage can reciprocate in the width direction (indicated by arrows a and b) of a recording medium 170, such as a recording sheet, which is carried by means for carrying a recording medium. In this respect, the structure is arranged to make the ink container and the head unit separable from each other.

In FIG. 12, when driving signals are supplied from driving signal supply means (not shown) to ink discharge means on the carriage HC, recording ink is discharged from the ink head unit 200 to the recording medium 170 in accordance with such signals.

Also, the ink jet recording apparatus exemplified herein comprises a motor 161 which serves as the driving source to drive the recording medium carrying means and the carriage HC; the gears 162 and 163 which transmit the driving power from the driving source to the carriage HC; and a carriage shaft 164, among some others. With the recording apparatus thus arranged, it is possible to obtain recorded objects of good images by discharging ink to each of the various kinds of recording media.

Figure 13:
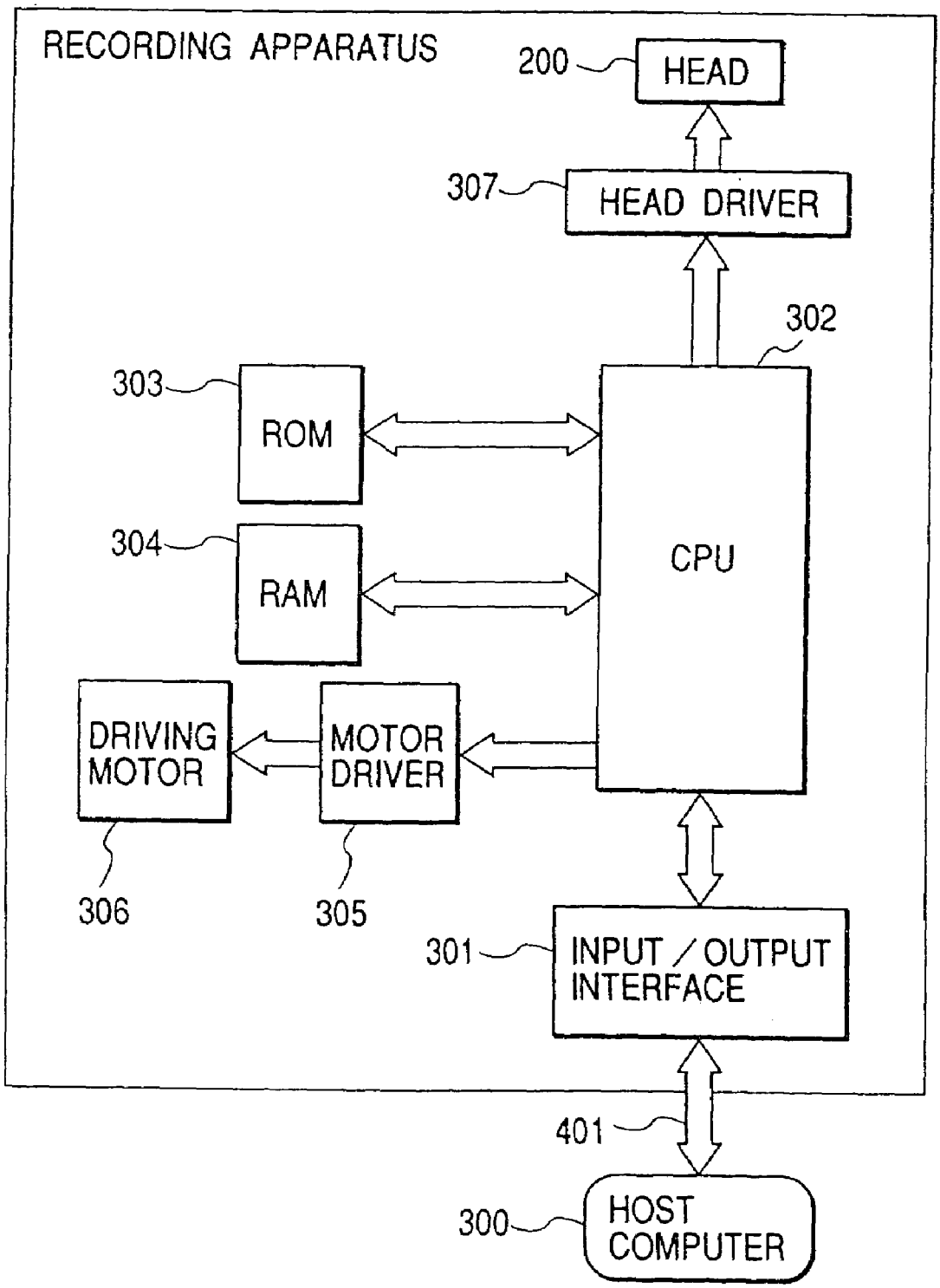
FIG. 13 is a block diagram which shows the entire system to operate the ink jet recording apparatus to which the present invention is applicable.

FIG. 13 is a block diagram which shows the entire system to operate the ink jet recording apparatus to which the ink jet head of the present invention is applicable.

The recording apparatus receives printing information from a host computer 300 as control signals. The printing information is provisionally stored on the input and output interface 301 provided for the interior of a printing apparatus, and at the same time, converted into the data that can be processed in the recording apparatus, thus being inputted into the CPU 302 that dually serves as means for supplying head driving signals. In accordance with the control program stored on a ROM 303, the CPU 302 processes the data which have been inputted into the CPU 302 by use of a RAM 304 and other peripheral units, and convert them printing data (image data).

Also, in order to record the image data on appropriate positions on a recording sheet, the CPU 302 produces the driving data which are required to drive the driving motor 306 that enables the recording sheet and the head 200 to move in synchronism with the image data. The image data and the motor driving data are transmitted to the head 200 and the driving motor 306 through the head driver 307 and the motor driver 305. Thus, images are formed by them which are driven in accordance with the controlled timing, respectively.

As a recording medium applicable to the aforesaid recording apparatus, which enables liquid, such as ink, to be provided therefor, there are various kinds of objects: paper, plastic materials used for OHP sheets, compact disks, or ornamental boards, cloths, metallic materials, such as aluminum, copper, leather materials, such cowhide, pigskin, artificial leathers, wood materials, such as woods, plywood, bamboo materials, ceramic materials, such as tiles, or three-dimensional structures, such as sponge, among some others.

Also, as the aforesaid recording apparatus, there is included a printer that records on various kinds of paper, OHP sheets, or the like, a recording apparatus for use of plastics that records on compact discs or other plastic materials, a recording apparatus for use of metals that records on metallic plates, a recording apparatus for use of leathers that records on leathers, a recording apparatus for use of woods that records on woods, a recording apparatus for use of ceramics that records on ceramic materials, a recording apparatus for use of three-dimensional net structure, such as sponge, or a textile printing apparatus that records on textiles, or the like.

Also, as the discharging liquid which is used for these kinds of ink jet recording apparatuses, ink may be used in accordance with each of the recording media and recording conditions.

Now, the description will be made of one example of ink jet recording system to record on a recording medium by use of an ink jet head of the present invention as the recording head thereof.

Figure 14:
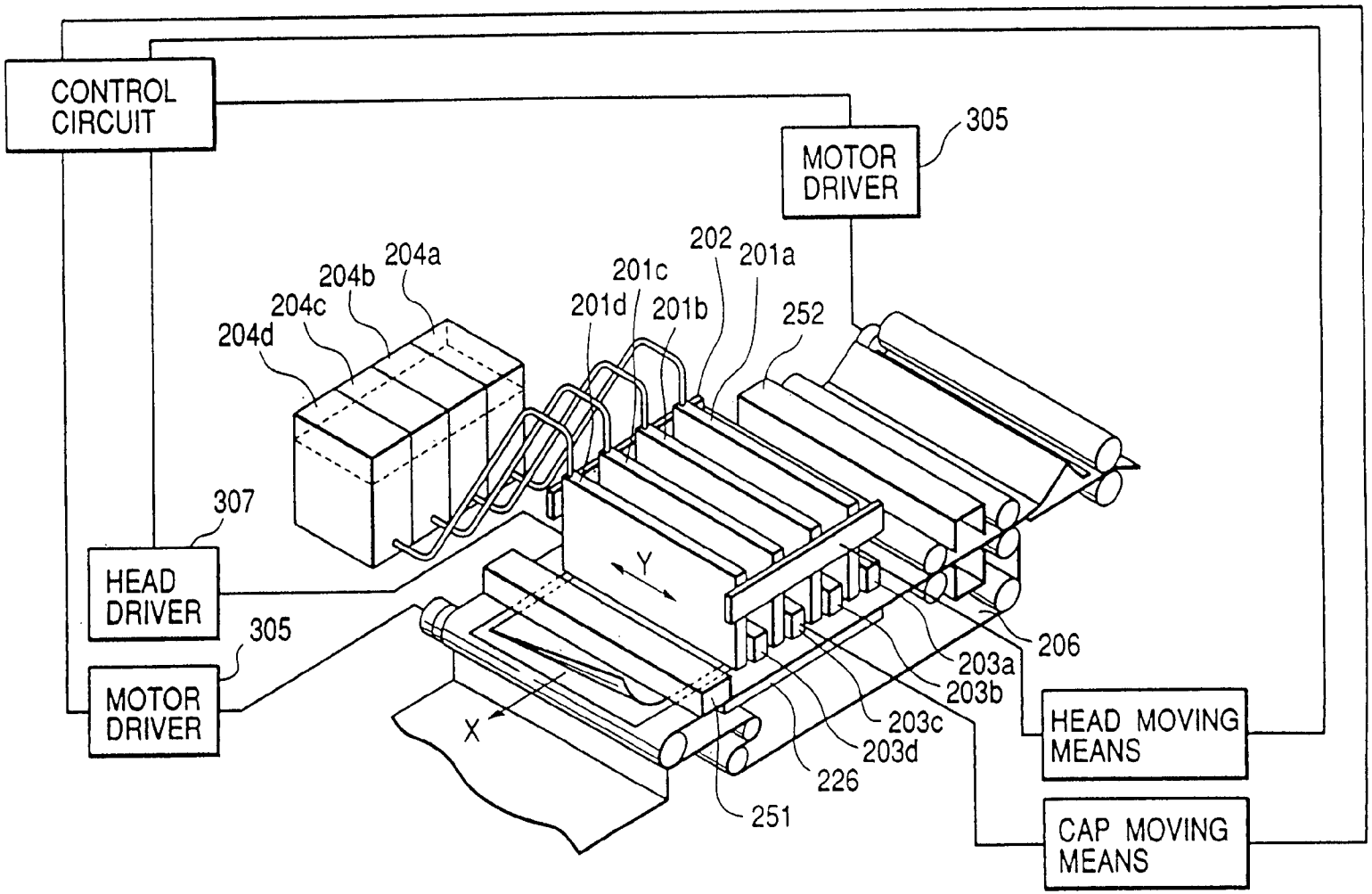
FIG. 14 is a view which shows the liquid discharge system to which the present invention is applicable.
Figure 15:
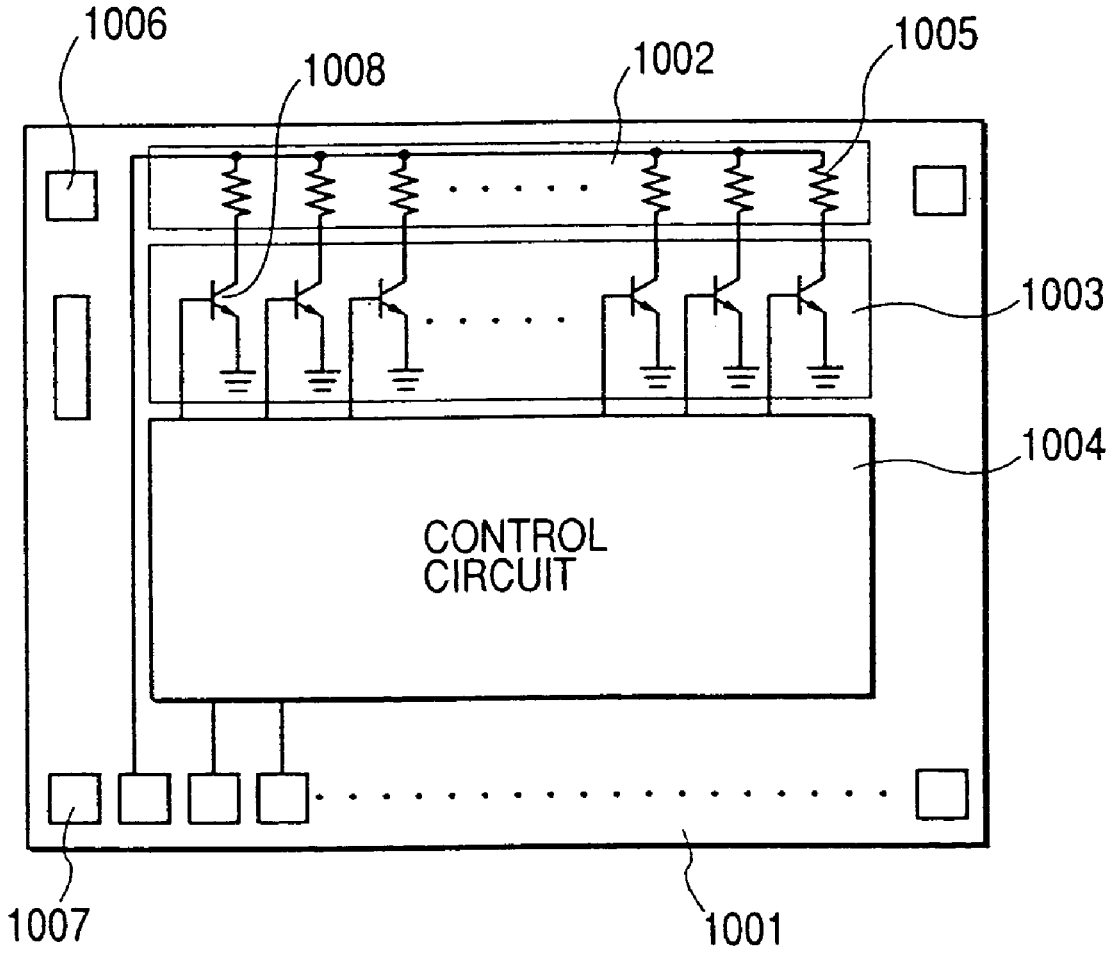
FIG. 15 is a view which shows the circuit structure of the elemental base plate of the conventional head.

FIG. 14 is a view which schematically illustrates the structure of the ink jet recording apparatus that uses the ink jet head of the present invention described earlier. The ink jet head of the present embodiment is the head of full line type in which a plurality of discharge ports arranged at intervals of 360 dpi in a length corresponding to the recordable width of a recording medium. Then, four heads 201*a* to 201*d*, which correspond to yellow (Y), magenta (M), cyan (C), and black (Bk), respectively, are fixedly supported a holder 202 in parallel in the direction X at specific intervals.

To these heads 201*a* to 201*d*, signals are supplied from the head driver 307 which constitutes driving signal supply means, respectively. In accordance with such signals, each of the heads 201*a* to 201*d* is driven. Then, to each of the heads 201*a* to 201*d*, each of the four color ink Y, M, C, and Bk is supplied from each of the ink containers 204*a* to 204*d*.

Also, below each of the heads 201*a* to 201*d*, head caps 203*a* to 203*d* are arranged, each having sponge or some other ink absorbent in the interior thereof to cover the discharge ports of each head 201*a* to 201*d* for the maintenance of heads 201*a* to 201*d*.

Here, a reference numeral 206 designates a carrier belt that constitutes carrying means for carrying each kind of recording media described in conjunction with the previous example. The carrier belt 206 is drawn around various kinds of rollers through a specific passage, which is driven by driving rollers connected with the motor driver 305.

For the ink jet recording apparatus hereof, a pre-processing device 251 and a post-processing device 252, which perform various processes of the recording medium before and after recording, are arranged on the upstream and downstream of the recording medium carrying path, respectively.

In accordance with the kind of a recording medium and the kind of ink with which recording is performed, the processing contents of the pre-process and post-process are different. For example, however, it becomes possible to enhance the adhesiveness of ink by irradiating ultraviolet rays and ozone on the surface of a recording medium, such as metal, plastic, ceramics, as the pre-processing, thus activating the surface of such medium. Also, for a recording medium which easily generates static electricity, such as plastics, dust particles tend to adhere to the surface thereof easily. Then, due to the adhesion of such dust particles, good recording may be impeded in some cases. As the pre-processing, therefore, it is preferable to use an ionizer system to remove static electricity, thus removing dust particles from the recording medium. Also, when cloths are used as a recording medium, it may be possible to execute a pre-processing by providing cloths with a substance that may be selected from among alkaline substances, water-soluble substances, synthetic polymer, water-soluble metallic salt, urea, and thiourea from the viewpoint of bleeding prevention, improvement of exhaustion degree, and the like. Here, the pre-processing is not necessarily limited to those mentioned above. It may be possible to adopt a treatment or the like that makes the temperature of a recording medium to the one which is most suitable for the intended recording.

On the other hand, the post-processing is such as to give heat treatment to a recording medium for which ink has been provided, fixing treatment that promotes the fixation of ink by the irradiation of ultraviolet rays or the like, a treatment that rinses off the processing agent which has been used for the pre-processing but still remains inactive, or the like.

Also, for the example herein, the description has been made using a full-line head as the heads 201*a* to 201*d*. However, the present invention is not necessarily limited thereto. It may be possible to adopt a mode in which a small head is carried in the width direction of a recording medium for recording.

Also, for the example herein, the description has been made of the recording elements that provide energy for discharging ink using as an example the ink jet head which is provided with heat generating elements formed by resistive devices. However, the present invention is also applicable to the ink jet head that uses the piezoelectric elements as the recording elements that discharge ink by piezo-effect or the thermal head that uses heat generating elements.

What is claimed is:

1. A recording head comprising:

a base plate;

a plurality of recording elements provided on said base plate for recording;

a driving circuit provided on said base plate for driving each of said plurality of recording elements; and a voltage generating circuit provided on said base plate for generating a plurality of different voltages from a predetermined voltage supplied from outside; and a control circuit for controlling said driving circuit, wherein the plurality of different voltages include a voltage to be applied to said plurality of recording elements, and a voltage to be supplied to said control circuit.

2. A recording head according to claim 1, wherein said plurality of recording elements are divided into plural groups, and said voltage generating circuit applies the plurality of different voltages per said group individually.

3. A recording head according to claim 1, wherein said voltage generating circuit enables the voltage to be supplied to said control circuit to rise, and then, the voltage to be applied to said plurality of recording elements to rise.

4. A recording head according to claim 1, wherein said voltage generating circuit enables the voltage to be applied to said plurality of recording elements to fall, and then, the voltage to be supplied to said control circuit to fall.

5. A recording head according to claim 1, wherein said voltage generating circuit applies the voltage to be applied to said plurality of recording elements to said plurality of recording elements only at a time of recording.

6. A recording head according to claim 1, wherein said voltage generating circuit makes values of the plurality of different voltages variable in accordance with specific control signals.

7. A recording head according to claim 1, wherein the plurality of different voltages are selected corresponding to resistance values of said plurality of recording elements.

8. A recording head according to claim 1, wherein the plurality of different voltages are selected corresponding to a number of said plurality of recording elements which are simultaneously driven.

9. A recording head according to claim 1, wherein a voltage for use by preheat pulses and a voltage for use by main pulses are made different and applied to said plurality of recording elements as the plurality of different voltages.

10. A recording head according to claim 9, wherein the voltage for use by main pulses is greater than the voltage for use by preheat pulses.

11. A recording head according to claim 1, wherein said plurality of recording elements generate energy for selectively discharging ink in a plurality of ink flow paths communicating respectively with a plurality of discharge ports for discharging the ink.

12. A recording head according to claim 11, wherein said plurality of recording elements are heat generating elements.

13. A recording head according to claim 11, wherein said plurality of recording elements are piezoelectric elements.

14. A recording head according to claim 1, wherein said recording head is a thermal head.

15. A substrate for use by a recording head comprising:

a base plate;

a plurality of recording elements provided on said base plate for recording;

a driving circuit provided on said base plate for driving each of said plurality of recording elements;

a voltage generating circuit provided on said base plate for generating a plurality of different voltages from a predetermined voltage supplied from outside; and a control circuit for controlling said driving circuit, wherein the plurality of different voltages include a voltage to be applied to said plurality of recording elements, and a voltage to be supplied to said control circuit.

16. A recording apparatus comprising:

a recording head provided with a base plate and a plurality of recording elements provided on said base plate for recording;

a driving circuit provided on said base plate for driving each of said plurality of recording elements;

a voltage generating circuit provided on said base plate for generating a plurality of different voltages from a predetermined voltage supplied from outside;

a control circuit for controlling said driving circuit;

a carriage having said recording head mounted thereon for traveling; and means for generating the predetermined voltage supplied from outside, wherein the plurality of different voltages include a voltage to be applied to said plurality of recording elements, and a voltage to be supplied to said control circuit.

* * * * *

UNITED STATES PATENT AND TRADEMARK OFFICE

CERTIFICATE OF CORRECTION

PATENT NO. : 7,055,923 B2
APPLICATION NO. : 10/975533
DATED : June 6, 2006
INVENTOR(S) : Muga Mochizuki et al.

It is certified that error appears in the above-identified patent and that said Letters Patent is hereby corrected as shown below:

COLUMN 1
Line 23, “complexly here,” should read --complexly. Here,--.
Line 53, “the” (second occurrence) should read --this--.

COLUMN 2
Line 6, “or-some” should read --or some--.
Line 33, “outputs” should read --output--.
Line 53, “ink the” should read --ink. The--.
Line 59, “gives” should read --give--.
Line 62, “enables” should read --enable--.

COLUMN 3
Line 27, “heat-generating” should read --heat generating--.
Line 32, “the time.” should read --times.--.
Line 33, “accordance” should read --accordance with--.

COLUMN 4
Line 52, “generating” should read --generate--.

COLUMN 5
Line 15, “form” should read --from--.

COLUMN 8
Line 24, “form” should read --from--.
Line 34, “form” should read --from--.
Line 53, “the time,” should read --times,--.

COLUMN 10
Line 27, “by” (first occurrence) should be deleted.

COLUMN 11
Line 7, delete “it is preferable form”.
Line 8, “circuit on” should read --circuit is preferably on--.
Line 67, “earlier the” should read --earlier. The--.

COLUMN 13
Line 8, “convert them” should read --converts them to--.
Line 25, “such” should read --such as--.
Line 57, “supported a” should read --supported by a--.

UNITED STATES PATENT AND TRADEMARK OFFICE

CERTIFICATE OF CORRECTION

PATENT NO. : 7,055,923 B2
APPLICATION NO. : 10/975533
DATED : June 6, 2006
INVENTOR(S) : Muga Mochizuki et al.

It is certified that error appears in the above-identified patent and that said Letters Patent is hereby corrected as shown below:

COLUMN 14
Line 67, "and" should be deleted.

Signed and Sealed this

Fourth Day of December, 2007

JON W. DUDAS
*Director of the United States Patent and Trademark Office*